US007644672B2

(12) United States Patent
Welbourn

(10) Patent No.: US 7,644,672 B2
(45) Date of Patent: Jan. 12, 2010

(54) MONOHULL SAILING VESSEL HAVING A LIFTING HYDROFOIL

(75) Inventor: Hugh Burkewood Welbourn, Devon (GB)

(73) Assignee: Dynamic Stability Systems Limited, Hong Kong (CN)

( * ) Notice: Subject to any disclaimer, the term of this patent is extended or adjusted under 35 U.S.C. 154(b) by 0 days.

(21) Appl. No.: 11/813,437

(22) PCT Filed: Apr. 5, 2007

(86) PCT No.: PCT/IB2007/001455

§ 371 (c)(1),
(2), (4) Date: Aug. 20, 2007

(87) PCT Pub. No.: WO2007/116318

PCT Pub. Date: Oct. 18, 2007

(65) Prior Publication Data

US 2009/0283023 A1 Nov. 19, 2009

(30) Foreign Application Priority Data

Apr. 7, 2006 (NZ) ..... 546441

(51) Int. Cl.
*B63B 35/00* (2006.01)

(52) U.S. Cl. ..... 114/39.24; 114/274; 114/282

(58) Field of Classification Search ..... 114/39.21, 114/39.24, 271, 274, 275, 277, 278, 280, 114/282, 284

See application file for complete search history.

(56) References Cited

U.S. PATENT DOCUMENTS

| | | | | |
|---|---|---|---|---|
| 2,858,788 | A | 11/1958 | Lyman | |
| 2,979,010 | A | 4/1961 | Braddon et al. | |
| 3,949,695 | A | 4/1976 | Pless | |
| 4,027,614 | A | 6/1977 | Jones | |
| 5,163,377 | A | 11/1992 | Calderon et al. | |
| 5,373,800 | A | 12/1994 | Steinberg | |
| 5,404,830 | A | 4/1995 | Ligozio | |
| 5,636,585 | A | 6/1997 | Schulz | |
| 6,499,419 | B1 | 12/2002 | Bussard | |
| 7,243,607 | B2 * | 7/2007 | Chesney et al. | 114/39.24 |

FOREIGN PATENT DOCUMENTS

| | | |
|---|---|---|
| DE | 41 19 430 A1 | 12/1992 |
| FR | 2 877 311 A | 5/2006 |
| GB | 1 581 627 A | 12/1980 |

* cited by examiner

*Primary Examiner*—Lars A Olson
(74) *Attorney, Agent, or Firm*—Young & Thompson

(57) ABSTRACT

A monohull sailing vessel (102, 202, 402, and/or 502) having a lifting hydrofoil (104 and/or 204) having a stowed position and a deployed position in which the hydrofoil extends outward of a leeward side of the hull (138). The hydrofoil may have an aspect ratio greater than 2.5:1, may be oriented at an angle of attack between 2 and 6 degrees, and may be oriented at a mean angle (124) of between 5 and 20 degrees to horizontal. The hydrofoil may have a projected area adapted provide a righting moment and a lifting force for partially but not fully lifting the vessel out of the water. The hydrofoil may have an exposed span (112) that is greater than about 7% of a height of the tallest mast (134). The vessel may include an actuation assembly (128, 228, 308, and/or 316) for moving the hydrofoil between the stowed and deployed positions.

24 Claims, 19 Drawing Sheets

MONOHULL SAILING VESSEL HAVING A LIFTING HYDROFOIL

TECHNICAL FIELD OF THE INVENTION

The invention relates to monohull sailing vessels, and is more specifically directed to monohull sailing vessels having a lifting hydrofoil for improving the performance of the monohull sailing vessel.

BACKGROUND OF THE INVENTION

In previously developed monohull sailing vessels, heeling forces from the sail plan are counteracted by the use of a fixed keel, the movement of the crew, movement of water or other ballast, or lately the utilization of swinging keels in the which the ballasted keel is mechanically swung towards the windward side of the vessel, or any combination of the above features.

The use of the swinging ballasted keel has provided the most benefit in terms of extracting more speed from sailing vessels of all sizes, but has resulted in a system that requires significant power input from either crew or stored power systems to operate. It also has the major drawback that any failure of the mechanical controlling devices or keel itself can and has resulted in totally uncontrolled movement of the ballasted keel and the subsequent destruction of the keel support area of the hull with disastrous and terminal damage that can and has resulted in the foundering of the vessel.

Many sailing vessels are known in the art that adopt some sort of hydrofoil system for improving stability and/or performance of the sailing vessel. Generally such hydrofoils are utilized in multi-hull designs and in some cases, monohull designs, with the intention of fully supporting the displacement of the vessel and lifting the vessel fully out of the water by dynamic forces only.

A hydrofoil, or more simply, a foil, is a streamline body designed to give lift and is similar to aircraft wings. The foil generally has a different curvature or camber at opposed surfaces. The static angle of attack (AoA) of a foil is the angle between the chord, defined as the straight line connecting the leading and trailing edge of the foil, and the direction of movement of the boat. Foils are designed to have a controllable AoA to achieve the desired lifting forces in various types of water and at various boat speeds, loads, wind conditions, etc. Many types of adjustment mechanisms are known for adjusting and controlling the AoA. However, such devices are complicated, prone to failure, require constant adjustment, require a highly knowledgeable operator, are costly, and add weight.

Another manner of controlling the lifting force produced by the hydrofoil is to adjust the projected area and/or span of the hydrofoil. By exposing more of the hydrofoil to the passing water, greater lift can be achieved. However, like controlling the AoA, controlling the projected area of the hydrofoil results in a system that is complicated, prone to failure, requires constant adjustment, requires a highly knowledgeable operator, is expensive, and adds weight.

Further, it has been found that previously developed hydrofoils used on monohull sailing vessels use hydrofoils that have aspect ratios (the ratio of the foils length, i.e. wingspan, relative to its width) that are less than 2:1. These low aspect ratio foils have been found to be inefficient in terms of lift to drag ratios and have been found to have insufficient span to provide a significant increase to the total righting moment. Thus the total beneficial effects have not been sufficient to overcome the inherent additional drag and their development has been abandoned. In addition, the fore and aft location of these foils has been such that they would significantly increase the total drag of the vessel and thus not result in any performance increases and again this has discouraged further progress along this line.

Accordingly, there exists a need for a hydrofoil system for a monohull sailing vessel that is less complicated, reliable, requires less frequent adjustments, may be operated with little instruction, is relatively inexpensive, and is light weight.

OBJECT OF THE INVENTION

It is an object of the invention to provide a monohull sailing vessel having a lifting hydrofoil that ameliorates some of the disadvantages and limitations of the known art or at least provides the public with a useful choice.

SUMMARY OF THE INVENTION

The illustrated embodiments of the present invention describe a hydrofoil system for monohull sailing vessels which provide increased performance from forces derived from dynamic effects for high performance monohull sailing vessels, in a manner that is inherently fail-safe and that in no way affects the ultimate seaworthiness of the vessel. The illustrated embodiments of the invention can also be configured for use in other lower performance sailing vessels such as cruising yachts in order to reduce the required sailing heel angles, increase the dampening of roll, and thus significantly improve the comfort level of the crew and performance of the vessel.

In one embodiment formed in accordance with the present invention, a lifting hydrofoil surface(s) is provided having a medium to high aspect ratio, one suitable example being a hydrofoil having an aspect ratio of about 2:1 or greater, which extends directly outward from a leeward side of a sailing vessel in an approximately horizontal orientation (when the vessel is at an optimum upwind heel angle) to provide a righting moment to counteract a heeling moment caused by the sails and a lifting force to partially lift the vessel out of the water to reduce drag.

Preferably, the lifting hydrofoil is moveable between a retracted position and an extended position. Preferably, the lifting hydrofoil is arranged so when the vessel is dead in the water and in a non-heeled state, some, if not all, of the lifting hydrofoil is out of the water, but when the sailing vessel is under sail and heeled to a natural sailing heel angle, at least a majority, and most preferably, all of the lifting hydrofoil is under water and at a substantially horizontal orientation.

One embodiment of a monohull sailing vessel formed in accordance with the present invention is disclosed. The vessel includes a hull with a longitudinal dimension, a bow, a stern, a port side, and a starboard side. The vessel may include at least one mast for supporting at least one sail, the mast coupled to the hull. The vessel may include a lifting hydrofoil having a stowed position in which the lifting hydrofoil is disposed inward of the hull and a deployed position in which the lifting hydrofoil is adapted to extend outward of a leeward side of the hull and in the water supporting the vessel. The lifting hydrofoil may have an aspect ratio that is greater than about 2.5:1. The lifting hydrofoil when in the deployed position may be oriented at a predetermined angle of attack to a fore and aft plane of the vessel, the predetermined angle of attack being between about 2 and 6 degrees. The lifting hydrofoil when in the deployed position may be oriented at a mean angle of between about 5 and 20 degrees to a horizontal plane when the vessel is in a non-heeled state so that the lifting hydrofoil is substantially parallel with the water plane when the vessel is heeled to a normal optimum sailing heel angle. The lifting hydrofoil when in the deployed position may have a projected area adapted to provide a righting moment tending to counteract a heeling moment applied by the sail of the vessel and a lifting force for partially but not fully lifting the vessel out of the water. The lifting hydrofoil may have an exposed span that is greater than about 7% of a height of the tallest mast of the vessel, the height measured from the water plane. The vessel may have an actuation assembly for moving the lifting hydrofoil between the stowed position and the deployed position.

The lifting hydrofoil may be coupled to the vessel such that the predetermined angle of attack of the lifting hydrofoil when in the deployed position and while the vessel is underway is static and not adapted for continuous adjustment to selectively control the lifting force produced by the lifting hydrofoil. The lifting hydrofoil may be coupled to the vessel such that the mean angle of the lifting hydrofoil relative to the horizontal plane when in the deployed position and while the vessel is underway is static and not adapted for continuous adjustment to selectively control the lifting force produced by the lifting hydrofoil. The lifting hydrofoil may be coupled to the vessel such that the projected area of the lifting hydrofoil when in the deployed position and while the vessel is underway is static and not adapted for continuous adjustment to selectively control the lifting force produced by the lifting hydrofoil. The lifting hydrofoil may be coupled to the vessel such that two or more of the angle of attack, the designed mean angle, and the projected area of the lifting hydrofoil when in the deployed position are static and not adapted for continuous adjustment to selectively control the lifting force produced by the lifting hydrofoil while the vessel is underway.

The lifting hydrofoil may be positioned along the longitudinal dimension within a predetermined distance of a centre of gravity of the vessel when in sailing trim, the predetermined distance being less than or equal to 15% of a length over all (LOA) of the vessel. The lifting hydrofoil may be positioned aft of the centre of gravity of the vessel. The exposed span of the lifting hydrofoil may be greater than about 7% and less than about 20% of the height of the tallest mast of the vessel, the height measured from the water plane. The projected area of the lifting hydrofoil may be sized such that the lifting force produced is able to lift at least a portion of a displacement of the vessel but less than 100% of the displacement when the vessel is underway and travelling at a maximum design speed.

The aspect ratio of the lifting hydrofoil may be greater than about 4:1. The exposed span of the lifting hydrofoil may be between 30% and 150% of a beam of the vessel measured at the waterline. The aspect ratio of the lifting hydrofoil may be between about 3:1 and 8:1. The static angle of attack of the lifting hydrofoil may be between about 3 and 5 degrees when in the deployed position. The actuation assembly may be adapted to rotate the lifting hydrofoil from the stowed position to the deployed position. The actuation assembly may be adapted to move the lifting hydrofoil athwartships from a starboard extended position in which a starboard end of the lifting hydrofoil is positioned outward of the hull and a port end of the lifting hydrofoil is positioned inward of the hull and a port extended position in which the port end of the lifting hydrofoil is positioned outward of the hull and the starboard end of the lifting hydrofoil is positioned inward of the hull.

The lifting hydrofoil may be oriented such that when the lifting hydrofoil is in the deployed position with the monohull sailing vessel in an unheeled state, a distal end of the lifting hydrofoil extends above the water plane. The lifting hydrofoil may be held in the deployed position by a load release mechanism adapted to release the lifting hydrofoil from the deployed position when an impact load upon the lifting hydrofoil exceeds a predetermined level. The lifting hydrofoil may be rotated between the deployed and stowed positions about a pivot axis that is oriented substantially perpendicular to the plane of the lifting hydrofoil.

The lifting hydrofoil may be housed in a slot in the hull that extends from the starboard side to the port side of the hull, and wherein the lifting hydrofoil is double ended such that the lifting hydrofoil is adapted to be deployed on either the starboard side or the port side of the hull by moving the lifting hydrofoil athwartship in the slot. The lifting hydrofoil may be bowed in the athwartship direction such that when the lifting hydrofoil is in the deployed position and the vessel in a non-heeled state, a distal end of the lifting hydrofoil is at a greater elevation than a proximal end of the lifting hydrofoil.

The vessel may include at least one lifting hydrofoil adapted to extend from the port side when in the deployed position and at least one lifting hydrofoil adapted to extend from the starboard side of the hull. The port lifting hydrofoil may be located in a different longitudinal position from the lifting hydrofoil on the starboard side such that the port and starboard lifting hydrofoils are offset from one another and the lifting hydrofoils are asymmetrically disposed about the vessel.

The lifting hydrofoil, when in the deployed position, may be positioned in a swept back orientation such that the lifting hydrofoil is inclined relative to a line oriented perpendicular to a centerline of the boat by a predetermined angle, the predetermined angle being greater than 5 degrees. The actuation assembly may be adapted to move the lifting hydrofoil between the stowed position and the deployed position by simultaneous linear and rotary actuation. The hull may include a channel disposed on the starboard and/or port side of the hull extending from a point below the waterline to a point above the waterline, the channel adapted to receive the lifting hydrofoil when the lifting hydrofoil is in the stowed position such that the bottom surface of the lifting hydrofoil is substantially flush with the hull

BRIEF DESCRIPTION OF THE DRAWINGS

The invention will now be described, by way of example only, by reference to the accompanying drawings.

DETAILED DESCRIPTION OF THE PREFERRED EMBODIMENT

Figure 1:
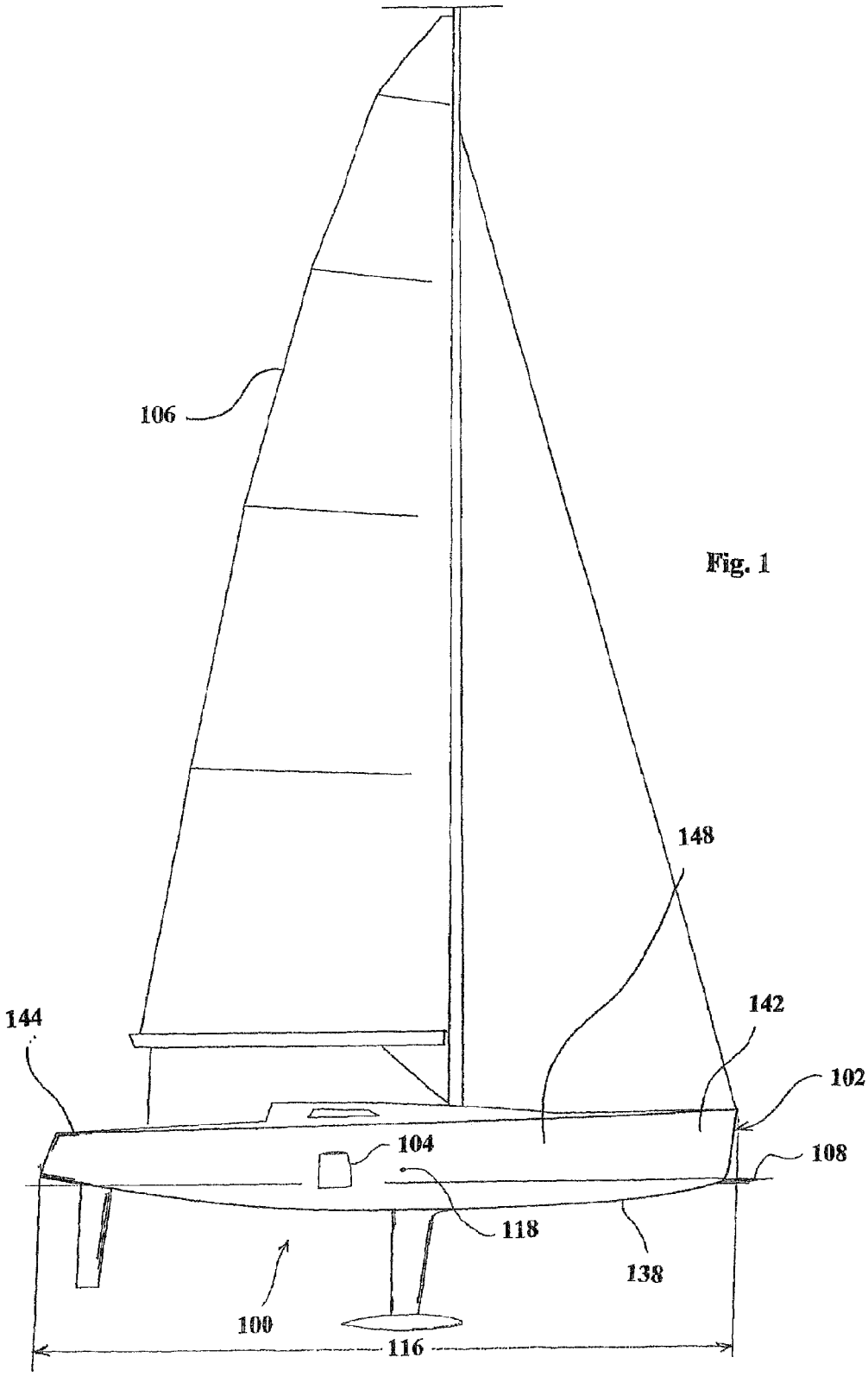
FIG. 1 is an elevation view of one embodiment of a monohull sailing vessel having a hydrofoil system formed in accordance with the present invention wherein a lifting hydrofoil is positioned into an extended position extending outward from a starboard side of the vessel by linear actuation of the lifting hydrofoil.

The following description will describe the invention in relation to preferred embodiments of the invention, namely a hydrofoil system for a monohull sailing vessel. The invention is in no way limited to these preferred embodiments as they are used purely to exemplify the invention only and it is noted that possible variations and modifications are readily apparent without departing from the scope of the invention.

Referring to FIGS. 1-6, one embodiment of a hydrofoil system 100 formed in accordance with the present invention is shown as applied to a monohull sailing vessel 102. The monohull sailing vessel 102 has a hull 138 with a longitudinal dimension 140, a bow 142, a stern 144, a port side 146, and a starboard side 148. The hydrofoil system 100 includes a lifting hydrofoil 104. The lifting hydrofoil 104 is positionable between a port extended position (not shown) in which the lifting hydrofoil 104 extends outward of the port side 146 of the hull 138 and into the passing water to create lift and a starboard extended position in which the lifting hydrofoil 104 extends outward of the starboard side 148 of the vessel and into the passing water to create lift. The lift created is used to apply a righting moment to counteract a heeling moment applied to the vessel by forces generated from the sails 106 and/or to apply a lifting force to at least partially lift the vessel from the water 108 to reduce drag.

The lifting hydrofoil 104 is positioned into the extended position on the leeward side of the vessel (i.e. opposite the windward side of the vessel which faces the wind), i.e, on the side of the vessel to which the vessel is heeled over to. In the illustrated embodiment, the lifting hydrofoil 104 is positioned into the extended position by linearly actuating the lifting hydrofoil 104 in a substantially transverse direction outward from a case or passageway 110 passing athwartship though the hull of the vessel. The case or passageway 110 may be water tight or alternately, non-water tight, and may or may not have doors or flaps used to seal off the ends of the passageway 110 flush with the hull to reduce drag. The lifting hydrofoil 104 may be a single hydrofoil that may be selectively extended from the passageway 106 to extend outward from either the port or starboard side of the hull depending on which side of the vessel happens to be the leeward side of the vessel at that particular moment. Alternately, separate hydrofoils may be used, i.e. a port hydrofoil and a starboard hydrofoil, each independently actuatable between an extended and stowed position as shown in FIGS. 7-23.

Alternately, to reduce drag, the lifting hydrofoil may be centerlined, i.e. positioned in a stowed position wherein the lifting hydrofoil is positioned within the passageway such that neither end of the lifting hydrofoil extends substantially outward of the passageway, and thus no or only negligible righting moments and/or lifting forces are produced. The ends of the lifting hydrofoil may lay flush with the outer surface of the hull, thus providing a streamlined surface while the lifting hydrofoil is in the stowed position.

Figure 2:
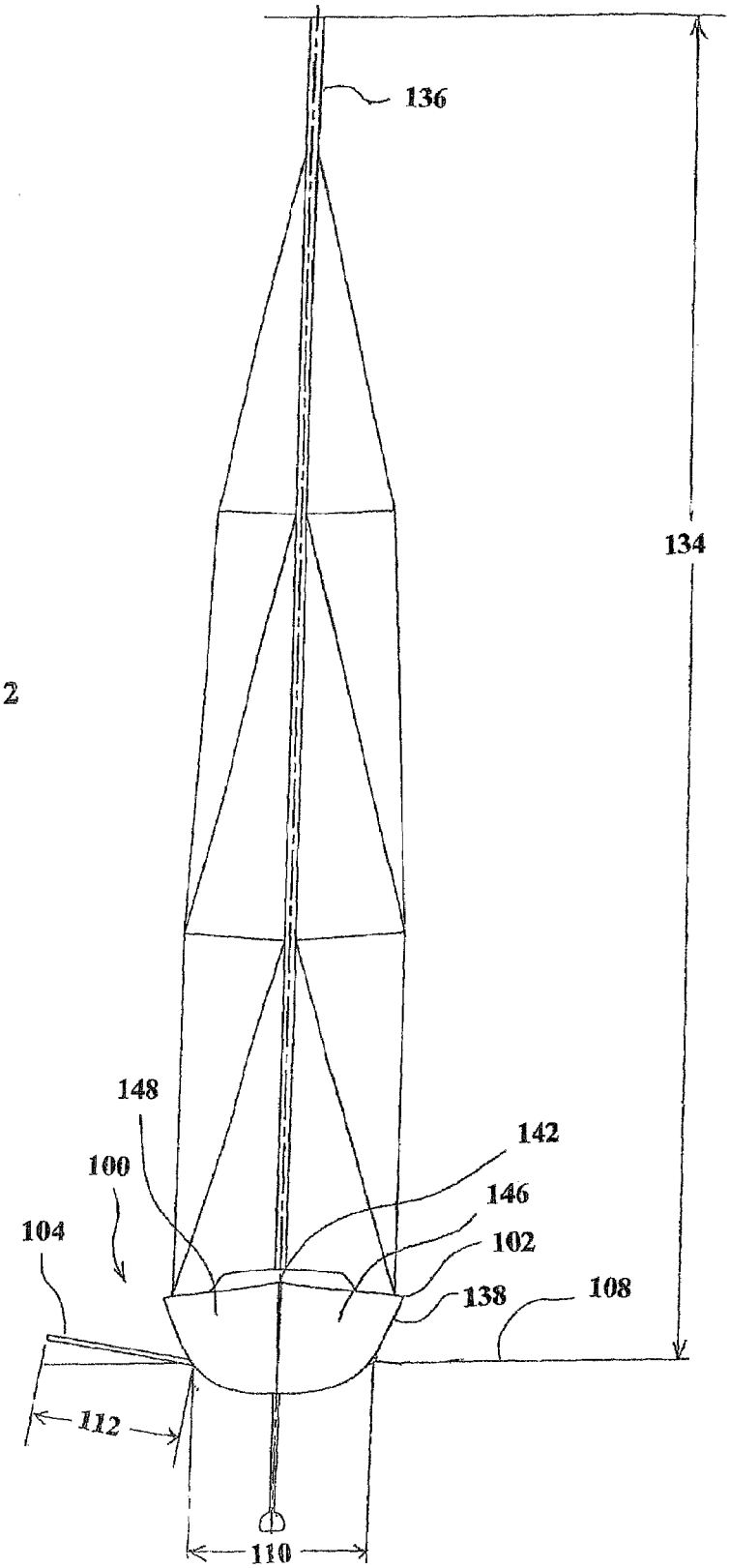
FIG. 2 is a front view of the bow of the vessel of FIG. 1.
Figure 3:
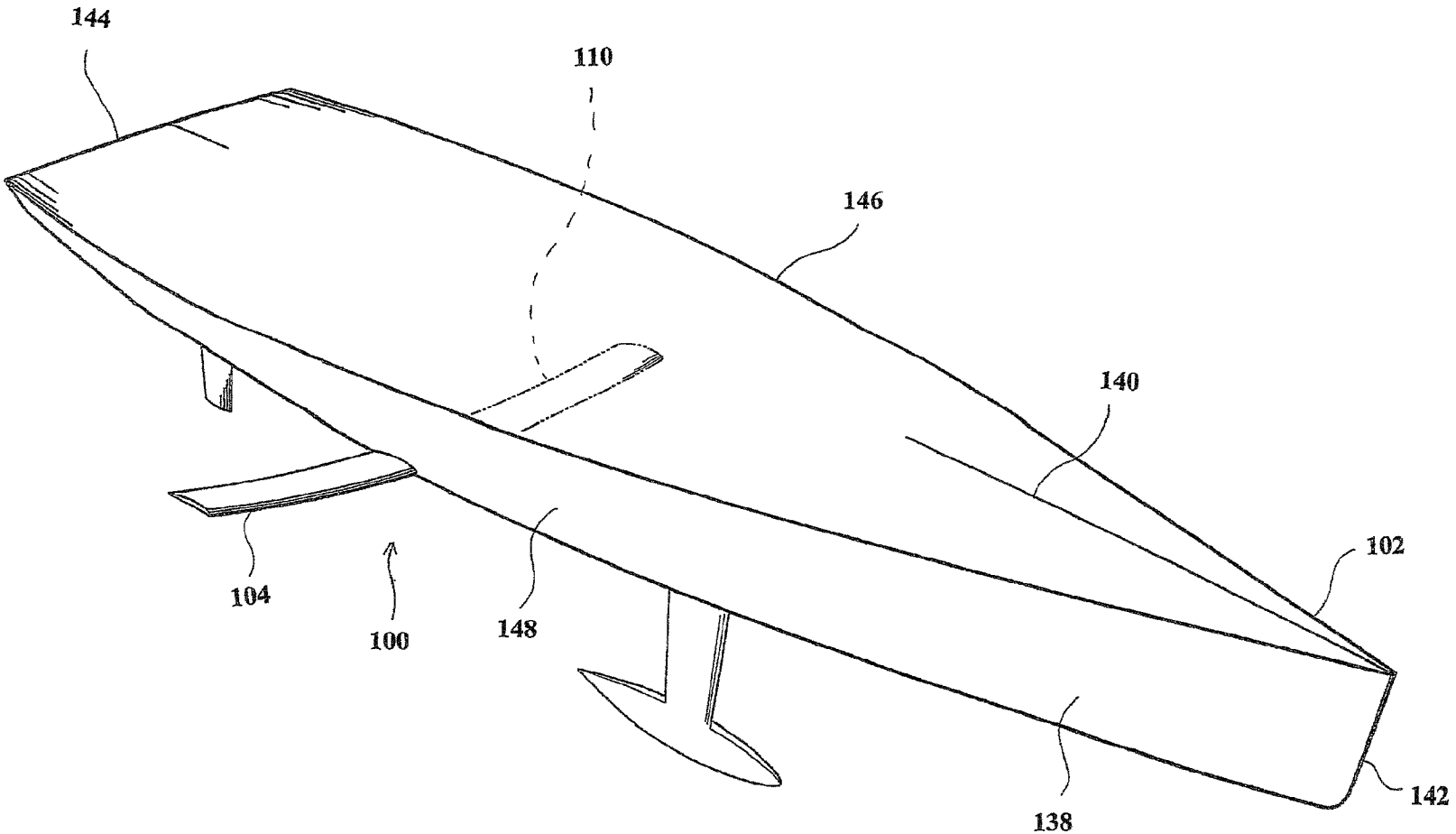
FIG. 3 is a perspective view of the starboard side of the vessel of FIG. 1 with all above deck structures removed for clarity.

Turning to FIG. 2, preferably, the lifting hydrofoil 104 has a length 112 extending outward of the hull when in the extended position that is between a lower limit of about 10%, 20%, 30%, 40%, 50%, 60%, 70%, 80%, or 90% of the beam 114 of the vessel measured at the waterline and an upper limit of about 60%, 70%, 80%, 90%, 100%, 110%, 120%, 130%, 140%, 150%, 160%, 170%, 180%, 190%, or 200% of the beam 114 of the vessel measured at the waterline. Most preferably, the lifting hydrofoil 104 has a length 112 extending outward of the hull when in the extended position that is between 30% and 150% of the beam 114 of the vessel measured at the waterline. Preferably the exposed span 112 of the lifting hydrofoil is greater than about 7% of the height 134 of the tallest mast 136 of the vessel, the height measured from the water plane 108. Preferably the exposed span 112 of the lifting hydrofoil is less than about 20% of the height 134 of the tallest mast 136 of the vessel, the height measured from the water plane 108.

Preferably, the lifting hydrofoil has a medium to high aspect ratio that is between about 2.5:1 and 10:1, preferably between about 3:1 and 6:1, and most preferably between about 4:1 and 6:1. The static angle of attack of the lifting foil is preferably between about 0 and 6 degrees, and most preferably between about 3 and 5 degrees so that variations of the angle of attack while the vessel is pitching in a seaway does not normally tale the cambered foil outside of its optimum lift/drag angles. The dynamic angle of attack as seen by the foil in the local water flow direction will preferably be between 0 and 5 degrees under steady state sailing conditions.

The foil sizing is preferably such that the drag reduction from the reduced displacement seen by the hull approximately compensates for the drag increase from the foil at a suitable speed when the natural optimum hull sailing angle is reached. Above that speed, then the benefits of the foil derived stability will increase the potential performance of the yacht as the forces derived from the foil increase with the square of the speed. Below that speed the foil is not required and thus can be retracted into the stowed position to reduce the drag to that of the normal hull only. When the lifting hydrofoil is in the deployed position, it is preferred that it has a projected area adapted provide a righting moment tending to partially or fully counteract a heeling moment applied by the sail of the vessel and generate a lifting force for partially but not fully lifting the vessel out of the water.

The lifting hydrofoil is preferably coupled to the vessel such that the predetermined angle of attack of the lifting hydrofoil when in the deployed position and while the vessel is underway is static and not adapted for continuous adjustment to selectively control the lifting force produced by the lifting hydrofoil. Further, the lifting hydrofoil is preferably coupled to the vessel such that the mean angle of the lifting hydrofoil relative to the horizontal plane when in the deployed position and while the vessel is underway is static and not adapted for continuous adjustment to selectively control the lifting force produced by the lifting hydrofoil. Also, the lifting hydrofoil is preferably coupled to the vessel such that the projected area of the lifting hydrofoil when in the deployed position and while the vessel is underway is static and not adapted for continuous adjustment to selectively control the lifting force produced by the lifting hydrofoil. By making one or more, and preferably each, of the predetermined angle of attack, mean angle of the lifting hydrofoil relative to the horizontal plane, and the projected area of the lifting hydrofoil non-adjustable, the operation of the lifting hydrofoil is greatly simplified.

Turning to FIG. 1, the foil placement in the longitudinal axis of the boat is arranged so the overall longitudinal trim of the vessel is automatically self-governed by the combined effects of the natural trim and heave characteristics of the hull and sail plan at various speeds and heel angles in conjunction with the heave and trim moments derived from the placement of the foil relative to the vessel's centre of gravity. Preferably, the longitudinal placement of the foil (when a single foil is used) is within 25% of the LOA 116 to either side of the LCG 118 of the vessel. Preferably, the foil is located aft of the LCG 118.

Figure 4:
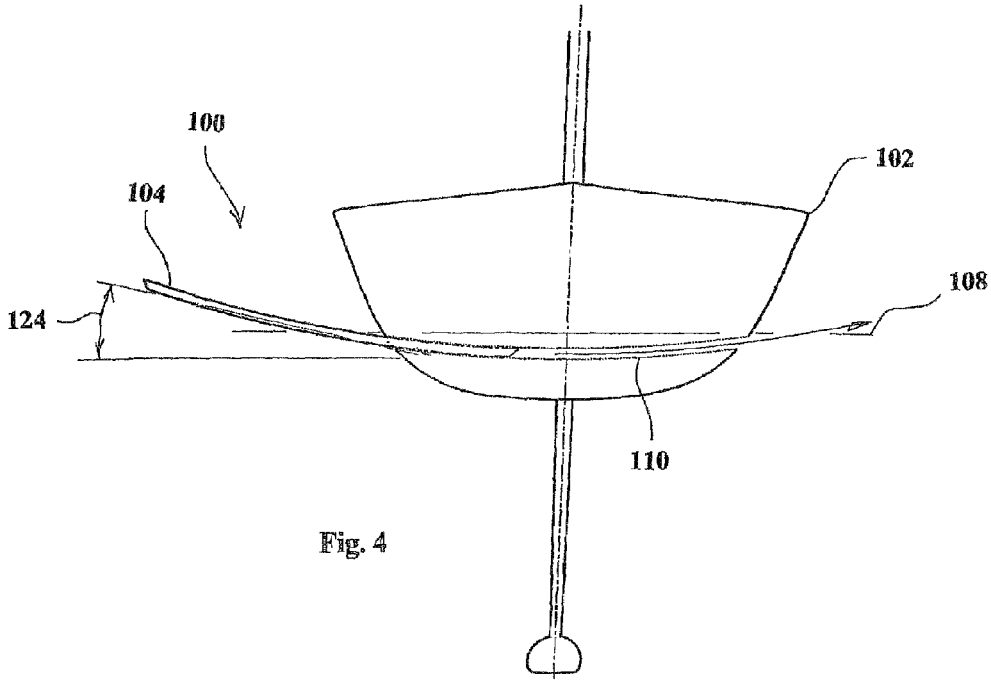
FIG. 4 is a front view of the vessel of FIG. 1 shown in a non-heeled state.
Figure 5:
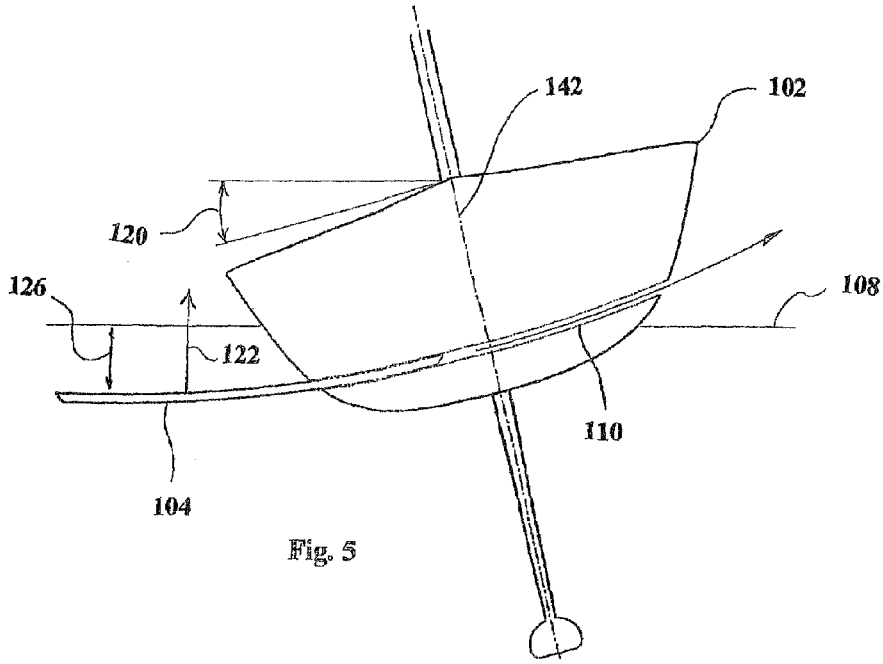
FIG. 5 is a front view of the vessel of FIG. 1 shown in a heeled state.

Referring to FIGS. 4 and 5, the foil may be curved upward. If curved, the foil 104 is preferably arranged such that when the vessel is heeled to the optimum upwind heel angle 120, the overall lifting vector 122 of the foil will be substantially in the vertical direction.

The primary intention of the foil is to provide a substantially vertical lifting vector to provide roll moment and reduction of displacement as seen by the vessel's hull. However, it is noted that addition of tip foils at the distal ends of the main foil such as to provide a side force component to resist leeway or reduce the tip vortex is also considered to be a possible configuration, and is within the spirit and scope of the present invention.

The foil may be oriented so as to be inclined from a horizontal plane when the vessel is not heeled. The angle of inclination is preferably chosen to approximate the optimum sailing heel angle such that when the vessel is heeled to the optimum sailing heel angle, the foil is oriented substantially horizontally. Accordingly, the foil is preferably inclined 124 from a horizontal plane between a lower limit of about 2, 5, 10, or 15 degrees and an upper limit of about 15, 20, 25, or 30 degrees, and most preferably between 5 and 25 degrees. If the lifting hydrofoil overcompensates the heel moment caused by the sails and begins to bring the vessel to ma upright position, the lifting hydrofoil begins to exit the water, thereby reducing the righting force generated by the lifting hydrofoil. Accordingly, it is seen that the lifting hydrofoil arranged as shown in the illustrated embodiment may act in a self correcting manner, thereby providing a means to reduce the amount of controls needed to operate the lifting hydrofoil system optimally.

This lifting hydrofoil is preferably arranged so that when the vessel is at rest, some, if not all, of the lifting hydrofoil may be clear of the water surface when in the extended position, and only contributes significantly to the righting moment when the boat heels to a natural sailing angle and thus fully immerses the foil to be approximately horizontal at the desired optimum heel angle. The intended operational immersion depth 126 at the lower speeds is preferably greater than 50% of the chord length of the foil in question. The intended operational immersion depth 126 at the lower speeds is preferably less than about 150% of the chord length of the foil in question.

The total righting moment produced by the lifting hydrofoil is a combination of the dynamic resultant forces from the foil and the normal righting moment experienced by the displacement and moments of the vessel in question. The lifting force of the foil or foils results in an increased righting moment, and also results in a reduction of the displacement of the hull while under way for a subsequent reduction in the drag of the hull.

Figure 6:
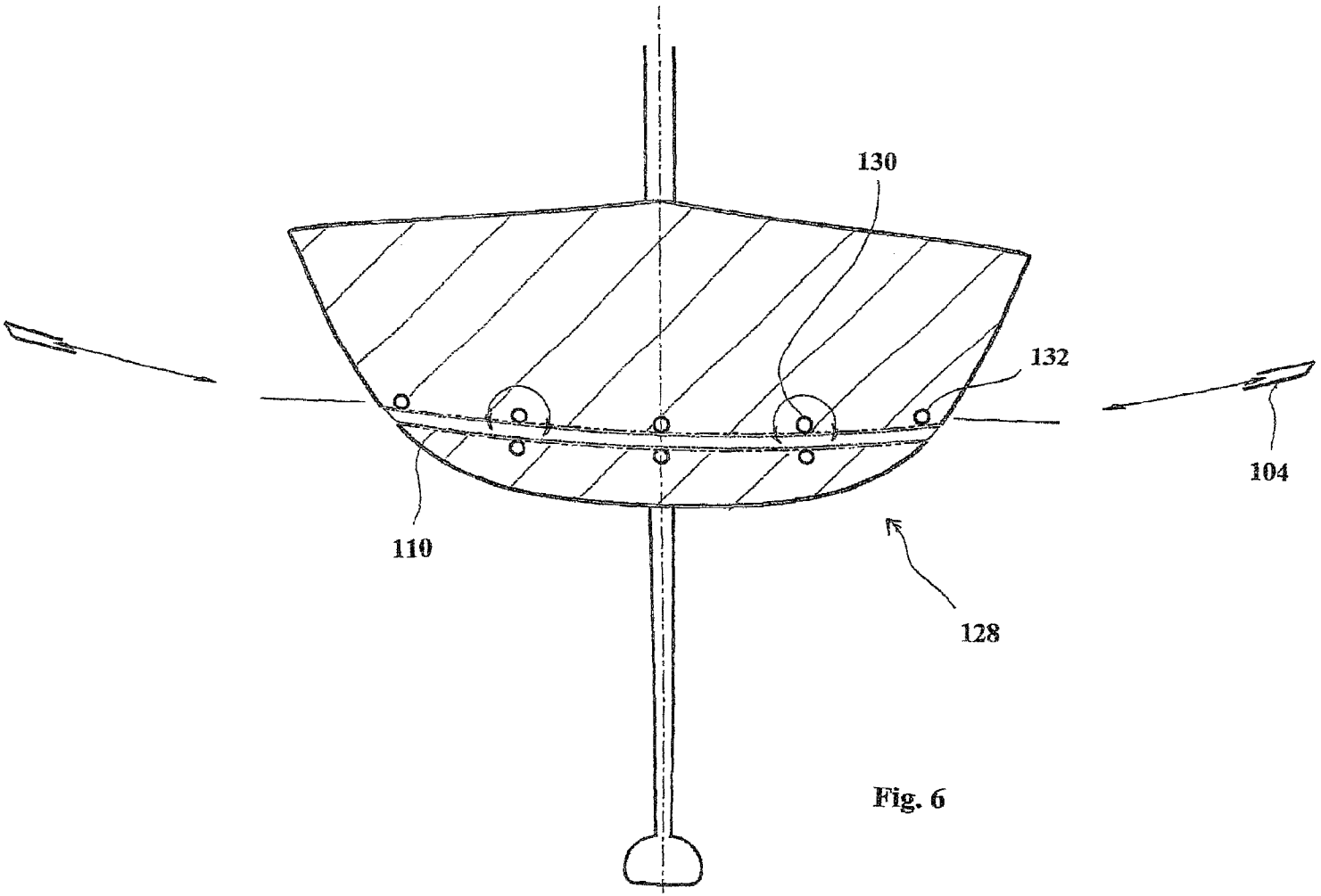
FIG. 6 is a front view of the vessel of FIG. 1 showing an actuation assembly for linearly moving the lifting hydrofoil between stowed and extended positions.
Figure 7:
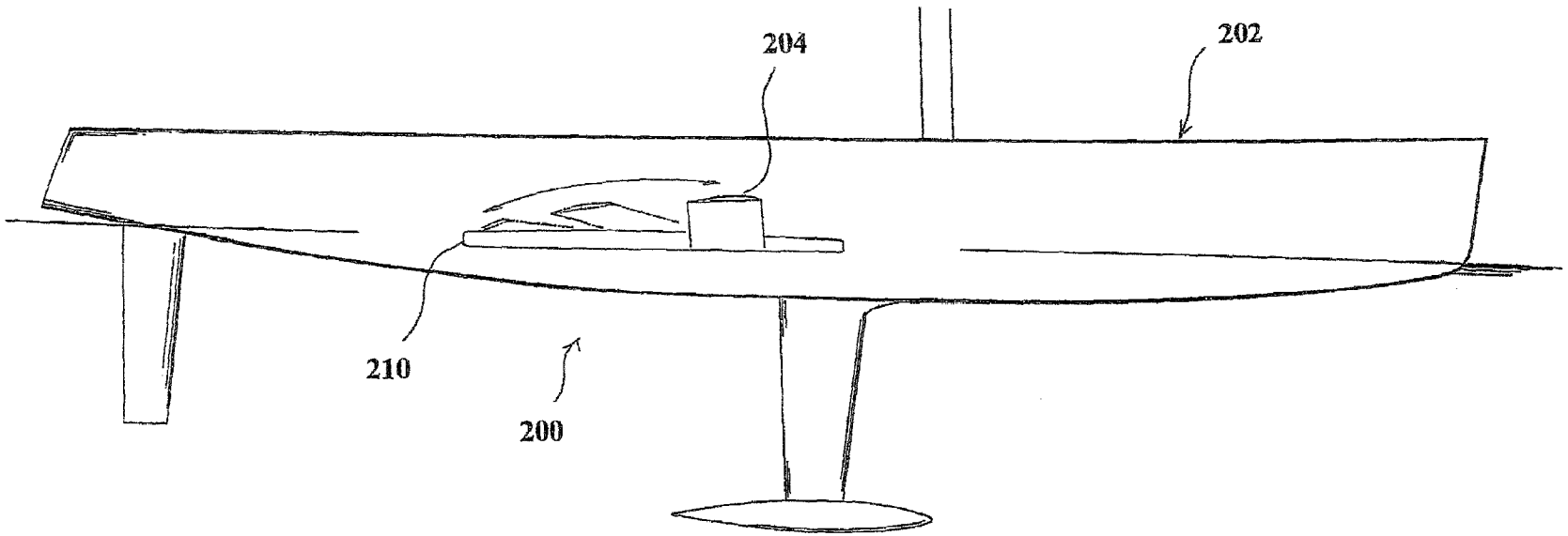
FIG. 7 is an elevation view of an alternate embodiment of a monohull sailing vessel having a hydrofoil system formed in accordance with the present invention wherein a lifting hydrofoil is positioned into an extended position extending outward from a starboard side of the vessel by rotary actuation of the lifting hydrofoil.
Figure 8:
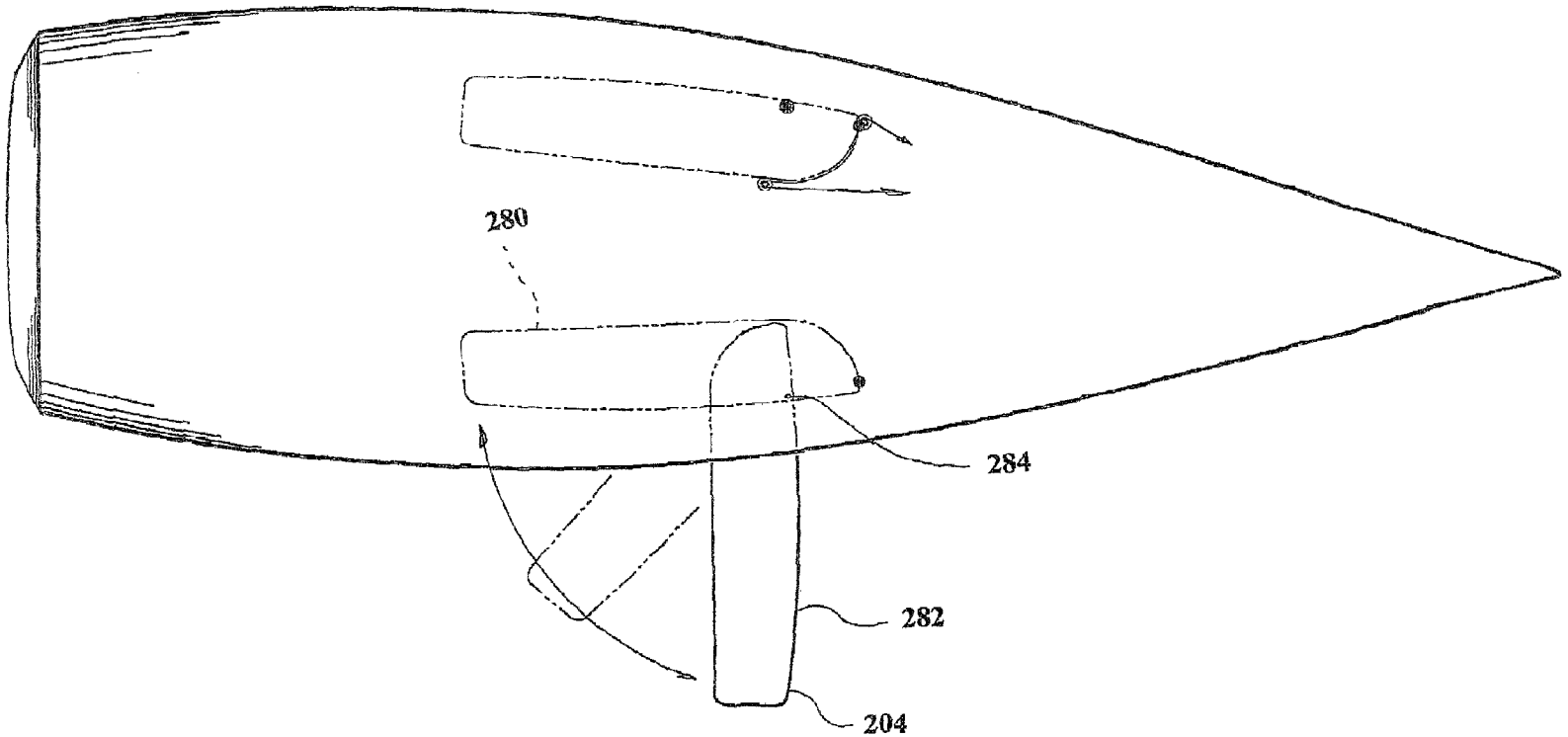
FIG. 8 is a top view of the vessel of FIG. 7.
Figure 9:
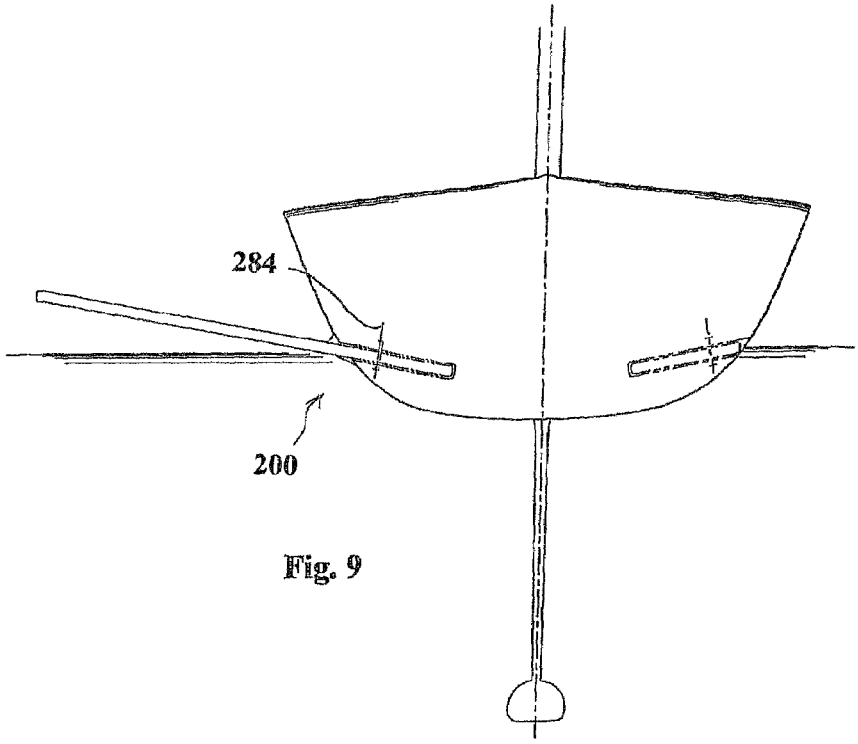
FIG. 9 is a front view of the vessel of FIG. 7 shown in a non-heeled state.
Figure 10:
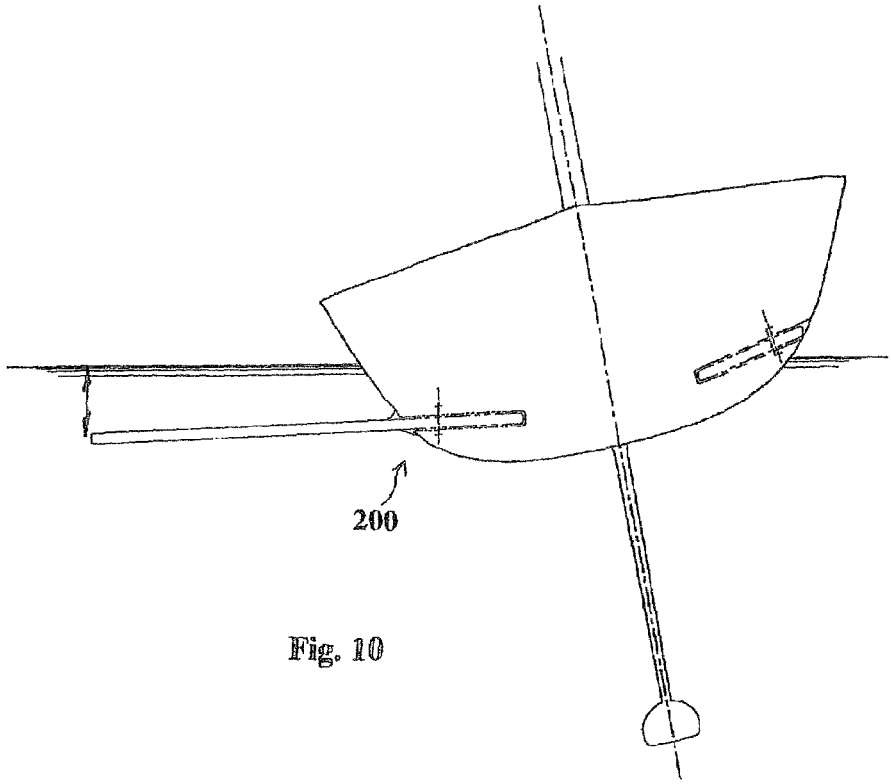
FIG. 10 is a front view of the vessel of FIG. 8 shown in a heeled state.

Referring to FIG. 6, an actuation assembly 128 for transitioning the lifting hydrofoil from its extended position on the port side, its stowed position, and its extended position on the starboard side is shown. The actuation assembly 128 includes one or more drive members 130, a few suitable examples being rollers or gears, which engage the lifting hydrofoil and drive the lifting hydrofoil through the passageway when rotated. The actuation assembly 128 may also include one or more guide members 132, such as rollers, which help support and guide the lifting hydrofoil 104 during actuation. The drive members 130 may be powered by any suitable means, and may be powered either manually or by machine.

FIGS. 7-11 illustrate an alternate embodiment of a hydrofoil system 200 formed in accordance with the present invention shown in combination with a monohull sailing vessel 202. The hydrofoil system 200 includes a lifting hydrofoil 204. The lifting hydrofoil 204 is positionable between a retracted position 280 (see FIGS. 8 and 11) in which the lifting hydrofoil is disposed within a storage pocket 210 and out of the water passing the hull of the vessel and all extended position 282 in which the lifting hydrofoil extends outward into the passing water to create lift. The lifting hydrofoil is similar in all aspects to the hydrofoil described above in relation to FIGS. 1-6 with the exception in the manner of actuation of the hydrofoil between the stowed and extended positions.

In the previous embodiment, the hydrofoil was linearly actuated through a passageway or case passing transversely through the hull to extend outward of either the port or starboard side of the vessel. In this embodiment, the lifting hydrofoil 204 is positioned into the extended position by rotary actuation of the lifting hydrofoil 204 about an axis 284 approximately normal to the top surface of the hydrofoil 204 (i.e. a substantially vertical axis when the vessel is heeled over). Preferably, the lifting hydrofoil is rotated forward from the stowage pocket 210 towards the bow, though alternately, it may be rotated aft. A door, flap, or other sealing system may be used to close off the opening of the stowage pocket 210 when the lifting hydrofoil 204 is in the extended position to maintain a streamline shape to the hull. Inasmuch as all other aspects of the hydrofoil system of this embodiment are identical to the above described embodiment, these aspects will not be redundantly described herein for the sake of brevity.

Figure 11:
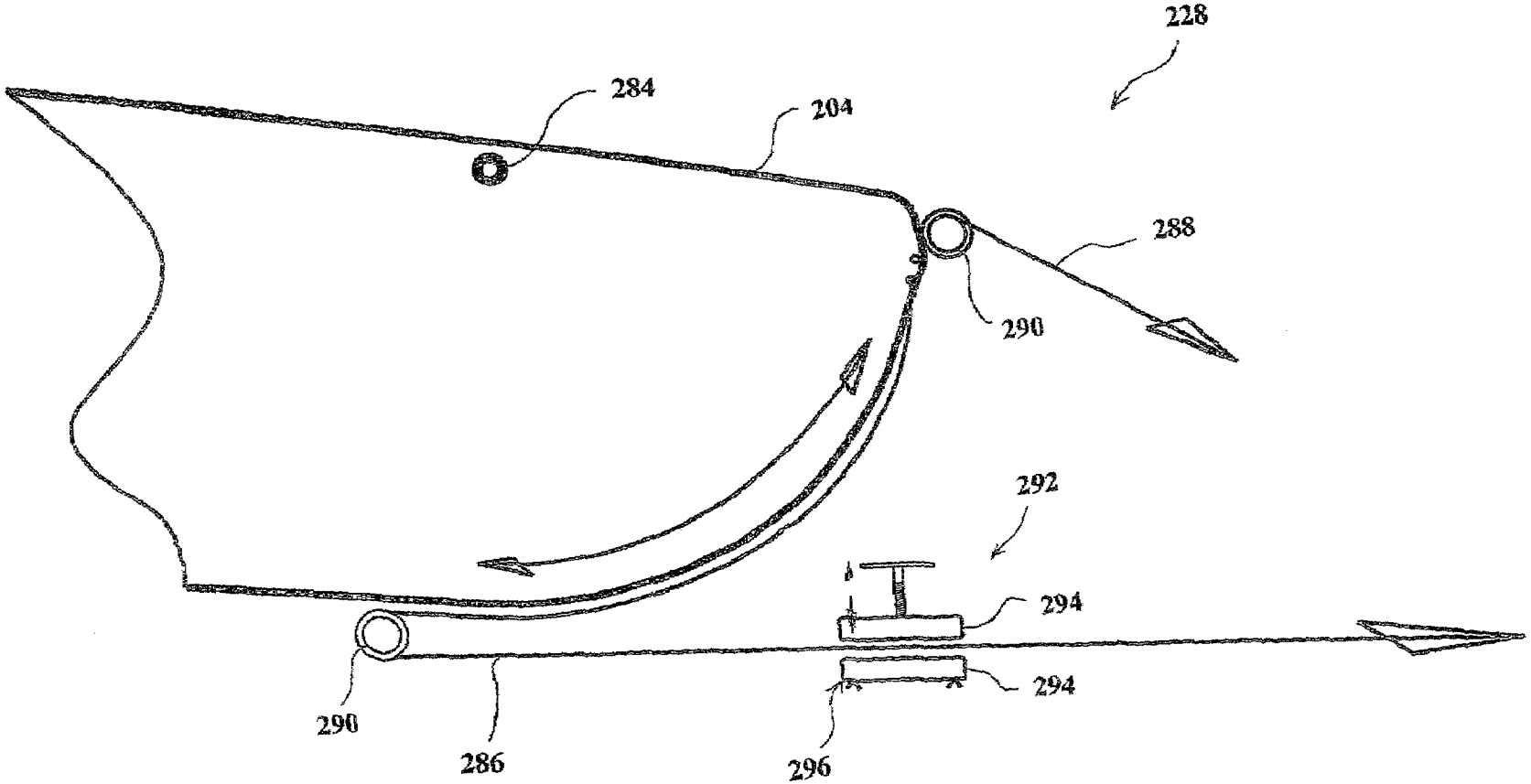
FIG. 11 is a top view of the actuation assembly used in rotating the lifting hydrofoil between the stowed and extended positions.

Turning to FIG. 11, a top view of an actuation assembly 228 for rotating the lifting hydrofoil between its stowed and extended positions is shown. The actuation assembly 228 includes a deployment line 286 and a retraction line 288, each run around a block 290. One end of each line 286 and 288 is coupled to the lifting hydrofoil 204. The other end of each line can be pulled upon, either manually or by machine, to cause the lifting hydrofoil to rotate about axis 284. For instance, by pulling on the deployment line 286, the lifting hydrofoil 204 is transitioned from the stowed position shown to the deployed position. By pulling on the retraction line 288, the lifting hydrofoil is transitioned back into the stowed position.

The actuation assembly 228 preferably includes a load release mechanism 292. The load release mechanism 292 holds the lifting hydrofoil in the deployed position until a predetermined load is exhibited upon the lifting hydrofoil. When the predetermined load is exhibited upon the lifting hydrofoil, the load release mechanism 292 is adapted to release the lifting hydrofoil from the deployed position to transition to the stowed position to prevent damage to the lifting hydrofoil and attached systems. For instance, if the lifting hydrofoil were to hit an object during operation, the load on the lifting hydrofoil would exceed the predetermined load, and the lifting hydrofoil would automatically be released and permitted to transition back to the stowed position to reduce the chance of damage to the hydrofoil and/or vessel.

In the illustrated embodiment, the load release mechanism 292 comprises a friction application device 296 which applies a predetermined friction force upon the deployment line 286, such as by clamping the line between two opposing friction pads 294. When the load upon the deployment line 286 exceeds a predetermined amount, the line 286 slides through the friction application device 296, permitting the foil to transition to the stowed position.

Figure 12:
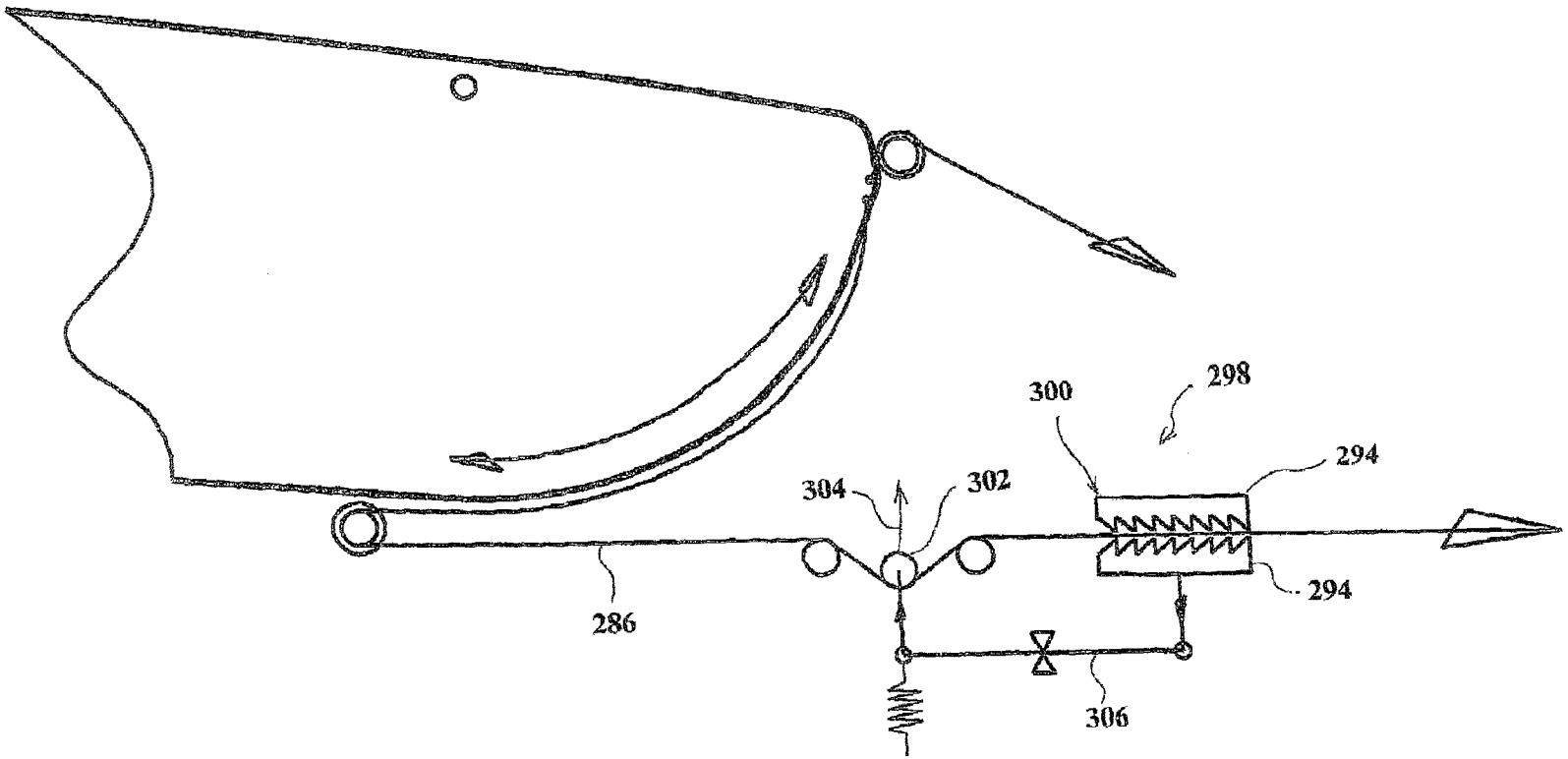
FIG. 12 is a top view of an alternate embodiment of the actuation assembly of FIG. 11.

Referring to FIG. 12, an alternate embodiment of a load release mechanism 298 is shown. In this embodiment, a friction application device 300 applies a predetermined friction force upon the deployment line 286, such as by clamping the line between two opposing friction pads 294 having teeth disposed thereon. When the load upon the deployment line 286 exceeds a predetermined amount, the tension in the line moves roller 302 in direction 304.

Inasmuch as roller 302 is attached to release line 306, which is in turn attached to one of the friction pads 294, the attached friction pad 294 is moved away form the other friction pad, thereby releasing the deployment line 286, permitting the lifting hydrofoil to transition back to the stowed position.

Figure 13:
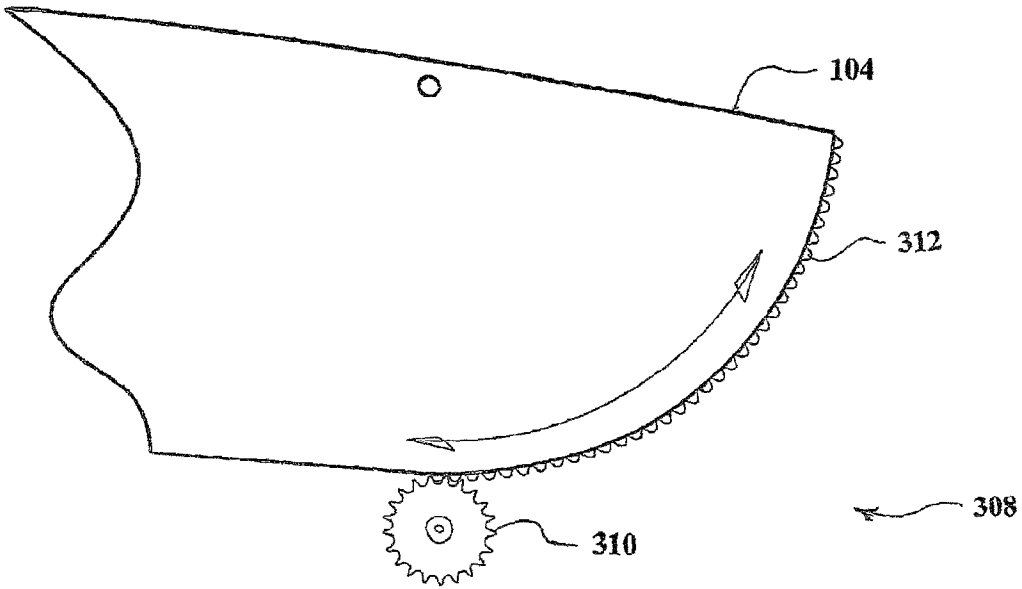
FIG. 13 is a top view of an alternate embodiment of the actuation assembly of FIG. 11.
Figure 14:
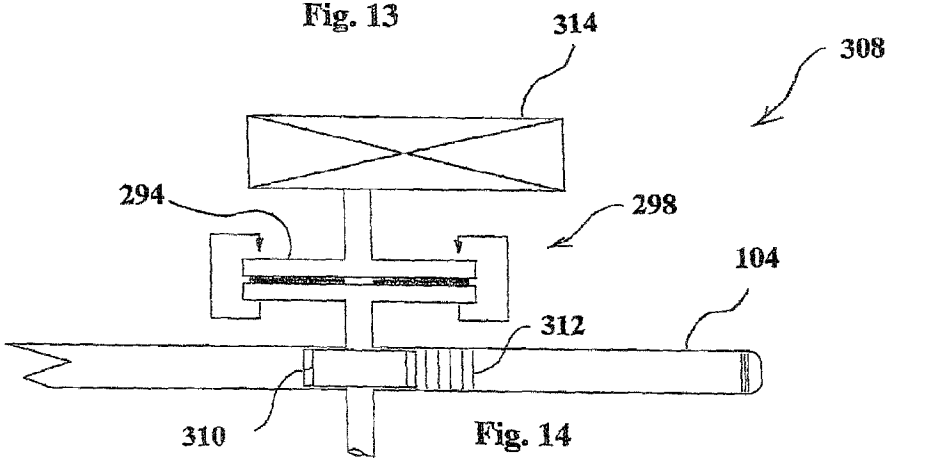
FIG. 14 is an elevation view of the actuation assembly of FIG. 13.

Referring to FIGS. 13 and 14, an alternate embodiment of an actuation assembly 308 for rotating the lifting hydrofoil between its stowed and extended positions is shown. The actuation assembly 308 includes a rotating drive member 310, one example being a drive gear 310, which engages the lifting hydrofoil 104 causing it to rotate between positions. In the illustrated embodiment, the rotating drive member 310 engages a plurality of gear teeth 312 disposed on the edge of the lifting hydrofoil 104.

Turning to FIG. 14, the actuation assembly 308 includes a drive source 314, a few suitable examples being an electric or hydraulic motor, for rotating the rotating drive member 310. Disposed between the drive source 314 and the rotating drive member 310 is a load release mechanism 298. The load release mechanism 298 is adapted to permit the rotating drive member 310 to rotate when a torque on the rotating drive member 310 exceeds a predetermined level, thereby permitting the lifting hydrofoil to transition back into a stowed position when the lifting hydrofoil 104 is struck by an object during use. In the illustrated embodiment, the load release mechanism 298 is in the form of a clutch having a pair opposing friction pads 294 which are clamped together by mechanical, electrical, hydraulic, or other means, to create a predetermined amount of friction between the two function pads 294. During normal operation, the function between the friction pads 294 ensures that rotating drive member 310 turns whenever the drive source 314 is actuated. However, when a large load is exhibited upon the rotating drive member 310, such as when the lifting hydrofoil impacts an object, the friction pads 294 begin to slip, permitting the rotating drive member 310 to rotate and the lifting hydrofoil 104 to rotate back to the stowed position.

Figure 16:
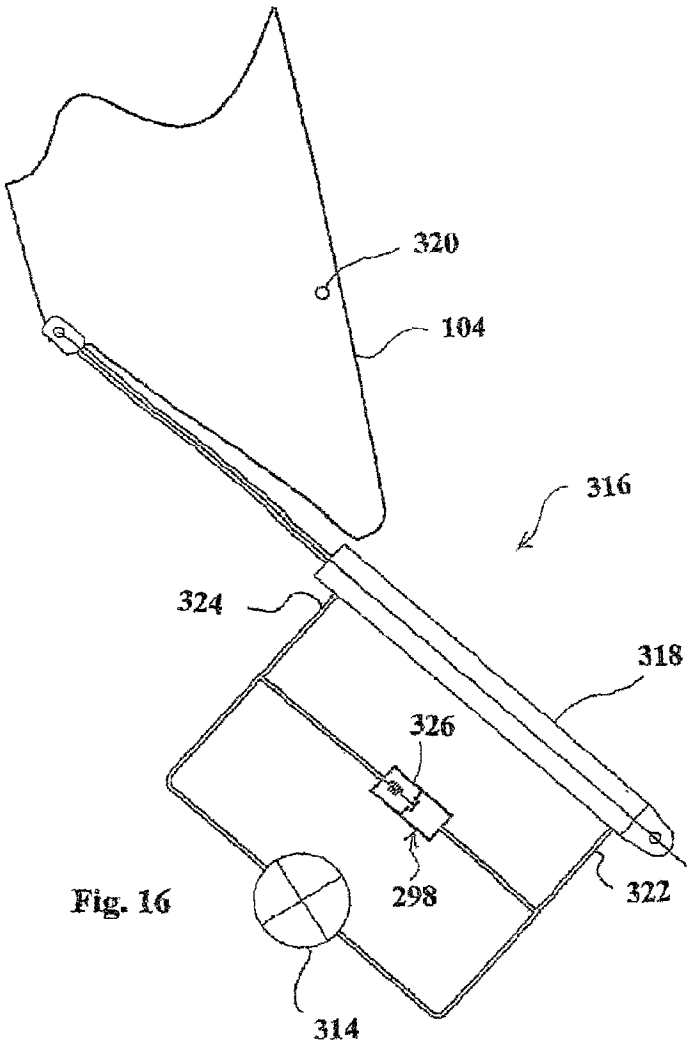
FIG. 16 is a top view of the actuation assembly of FIG. 15 showing the lifting hydrofoil in the extended position.
Figure 15:
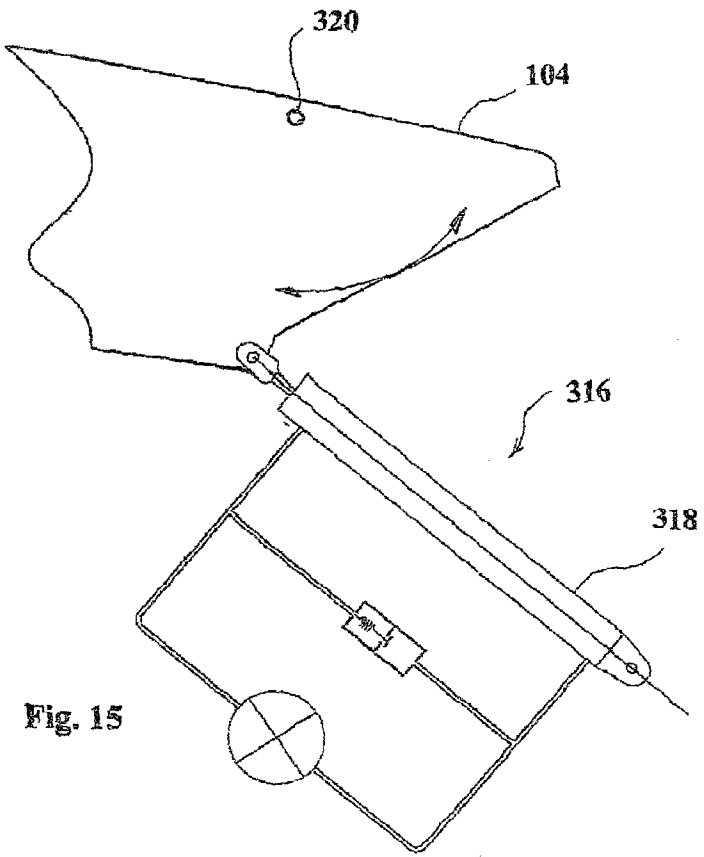
FIG. 15 a top view of an alternate embodiment of the actuation assembly of FIG. 11 showing the lifting hydrofoil in the stowed position.
Figure 17:
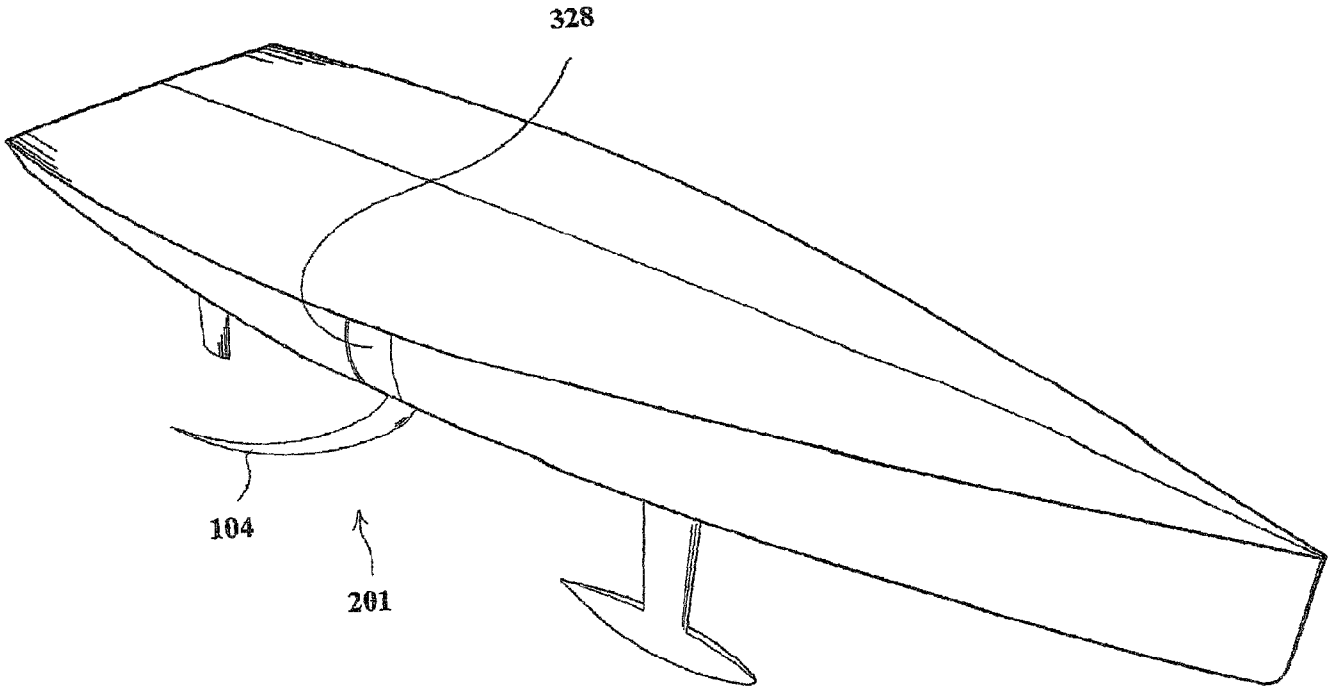
FIG. 17 is a perspective view of an alternate embodiment of a monohull sailing vessel having a hydrofoil system formed in accordance with the present invention wherein a lifting hydrofoil is positioned into an extended position extending outward from a starboard side of the vessel by rotary actuation of the lifting hydrofoil out of a channel disposed in the starboard side of the hull.
Figure 18:
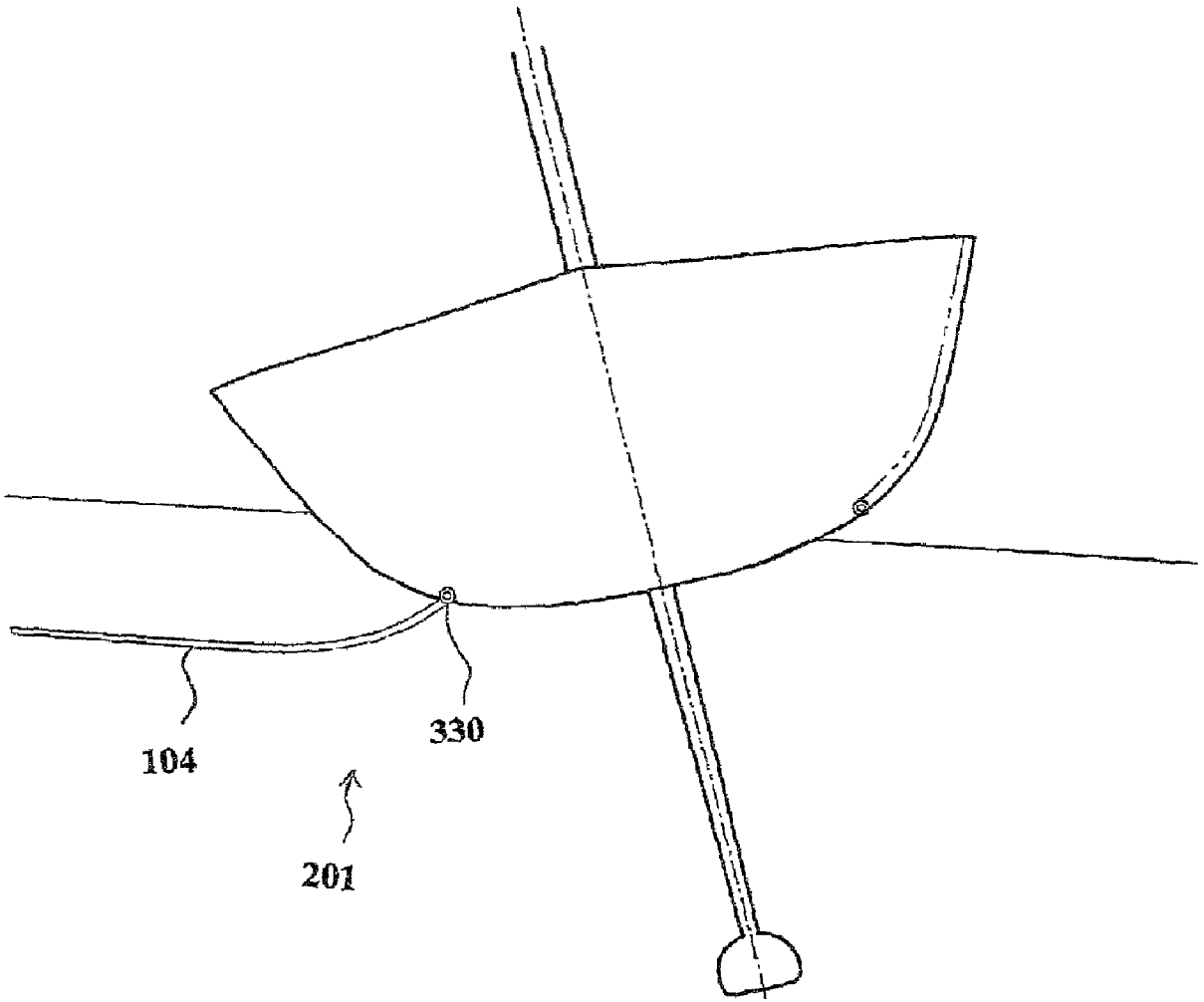
FIG. 18 is a front elevation view looking at the bow of the sailing vessel of FIG. 17 showing the lifting hydrofoil in the extended position.

Referring to FIGS. 15 and 16, an alternate embodiment of an actuation assembly 316 for rotating the lifting hydrofoil 104 between its stowed and extended positions is shown. The actuation assembly 316 includes a linear actuator 318, one example being a hydraulic ram, which is adapted to adjust in length to cause the lifting hydrofoil 104 to rotate between positions about a pivot assembly 320.

Turning to FIG. 16, the actuation assembly 316 includes a drive source 314, one suitable example being a hydraulic motor, for pumping/pressurizing hydraulic fluid. The drive source 314 is coupled in fluid communication with the linear actuator 318. The drive source 314 is adapted to selectively adjust the length of the linear actuator 318, such as by driving fluid into or out of the linear actuator 318.

Disposed between the inlet 322 and outlet 324 of the linear actuator 318 is a load release mechanism 298. The load release mechanism 298 is adapted to permit the linear actuator 318 to change in length when a force exhibited on the linear actuator 318 exceeds a predetermined load, thereby permitting the lifting hydrofoil to transition back into a stowed position when the lifting hydrofoil 104 is stuck by an object during use. In the illustrated embodiment, the load release mechanism 298 is in the form of a pressure relief valve 326 that permits hydraulic fluid to flow from the outlet to the inlet when a pressure of the fluid in the linear actuator 318 exceeds a predetermined level. During normal operation, the pressure relief valve 326 remains in a closed position ensuring that the linear actuator 318 changes in length whenever the drive source 314 is actuated. However, when a large load is exhibited upon the linear actuator 318, such as when the lifting hydrofoil impacts an object, the pressure relieve valve 326 opens, permitting the linear actuator 318 to change in length to permit the lifting hydrofoil 104 to rotate back to the stowed position.

FIGS. 17-23 depict various manners in which the lifting hydrofoils may be configured and transitioned between an extended position and a retracted position. For instance, referring to FIGS. 17 and 18, an alternate embodiment of a monohull sailing vessel having a hydrofoil system 201 formed in accordance with the present invention wherein the lifting hydrofoils 104 are positioned into an extended position extending outward from a side of the vessel by rotary actuation of the lifting hydrofoil out of a pocket or channel 328 disposed in the side of the hull is shown. More specifically, lifting hydrofoils 104 preferably have a bottom surface that substantially matches the shape of the hull. Each side of the hull includes a substantially vertically oriented pocket or channel 328 adapted to receive the lifting hydrofoil when in the stowed position. The lifting hydrofoil 104 is then rotated about a substantially horizontal and longitudinally aligned pivot axis 330 when transitioned between the extended and stowed positions. When in the stowed position, the bottom surface of the lifting hydrofoil is preferably flush relative to the outer surface of the hull such that the passing water may pass cleanly by with little or no increased drag caused by the lifting hydrofoil.

Figure 19:
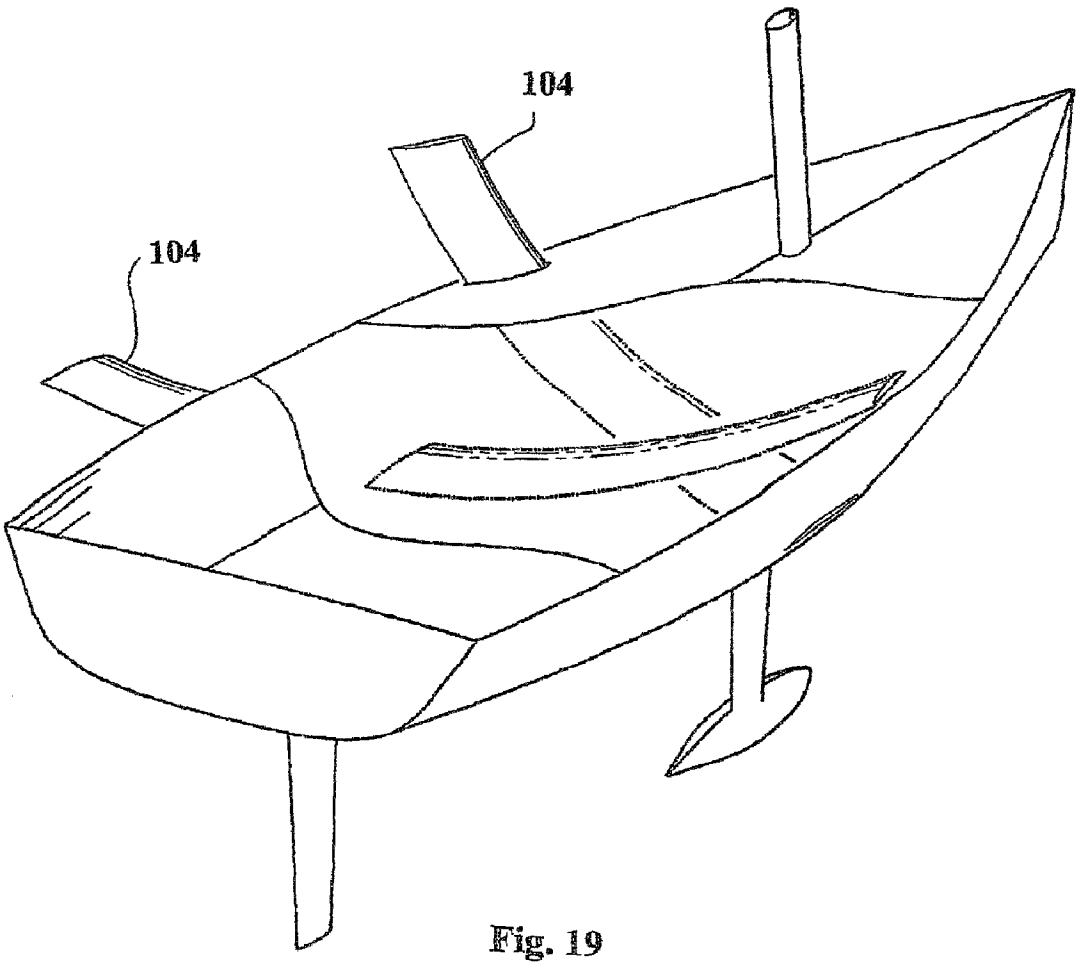
FIG. 19 is a perspective view of an alternate embodiment of a monohull sailing vessel having a hydrofoil system formed in accordance with the present invention wherein a pair of lifting hydrofoils are shown with the port lifting hydrofoil positioned into an extended position and the starboard lifting hydrofoil positioned in a stowed position wherein the lifting hydrofoils are oriented so as to be in a swept back configuration wherein the lifting hydrofoils are inclined aft relative to the centreline of the vessel at a predetermined angle.
Figure 20:
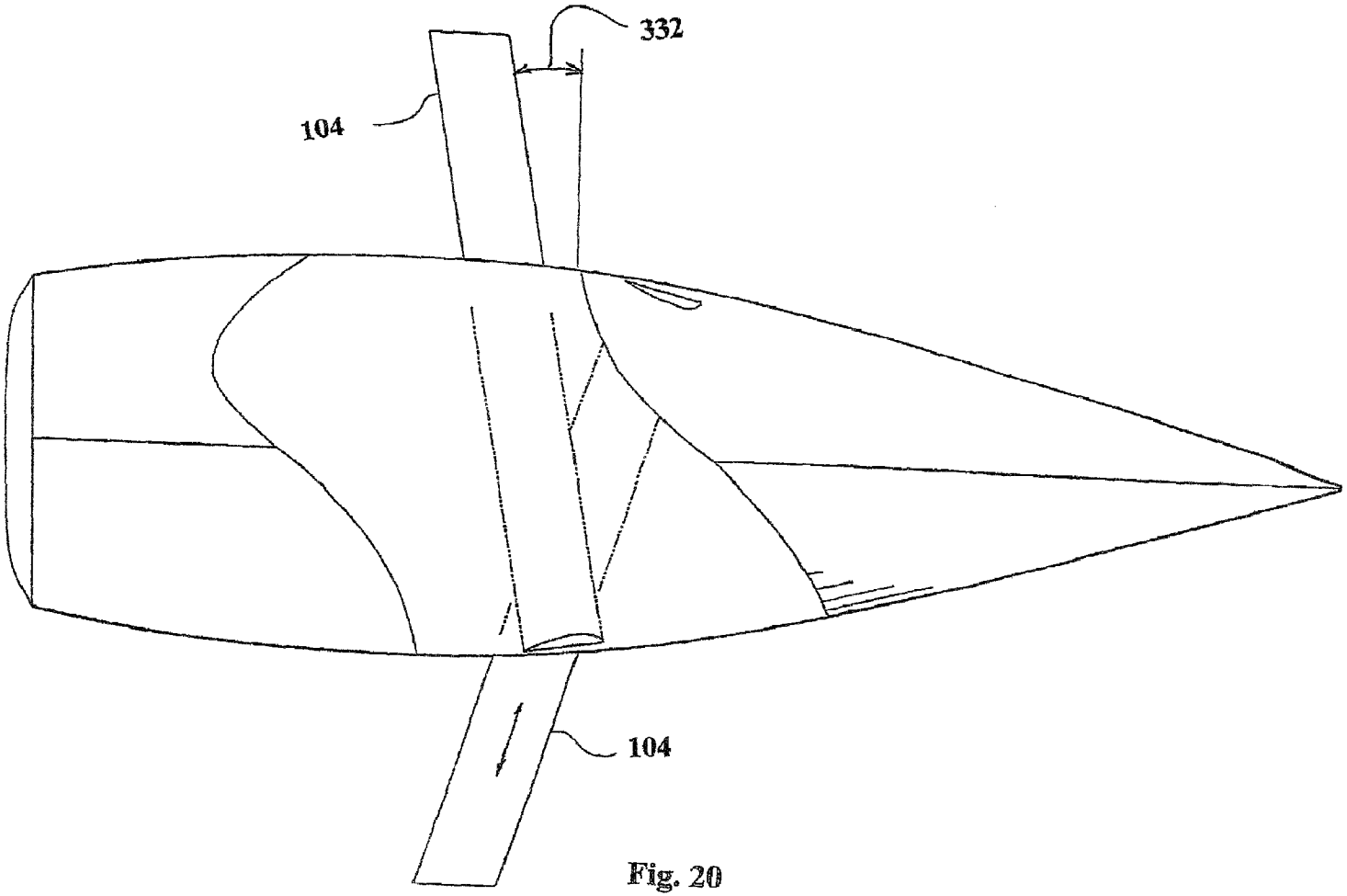
FIG. 20 is a top planar view of the sailing vessel of FIG. 19 showing both lifting hydrofoils in the extended position.

Turning to FIGS. 19 and 20, a monohull sailing vessel having an alternate embodiment of a hydrofoil system formed in accordance with the present invention is shown. In this embodiment, each of a pair of lifting hydrofoils 104 are positioned into an extended position by linearly actuating one of the lifting hydrofoils to the port side when needed and linearly actuating the other lifting hydrofoil to the starboard side of the vessel when needed. The lifting hydrofoils are oriented so as to be in a swept back configuration wherein the lifting hydrofoils are inclined aft relative to the centreline of the vessel at a predetermined angle 332. The predetermined angle 332 is preferably greater than a minimum angle, a few suitable examples being greater than 5, 10, or 15 degrees, and less than a maximum angle, a few suitable examples being 25, 35, and 45 degrees. Most preferably, the angle 332 is between about 5 and 20 degrees.

Figure 21:
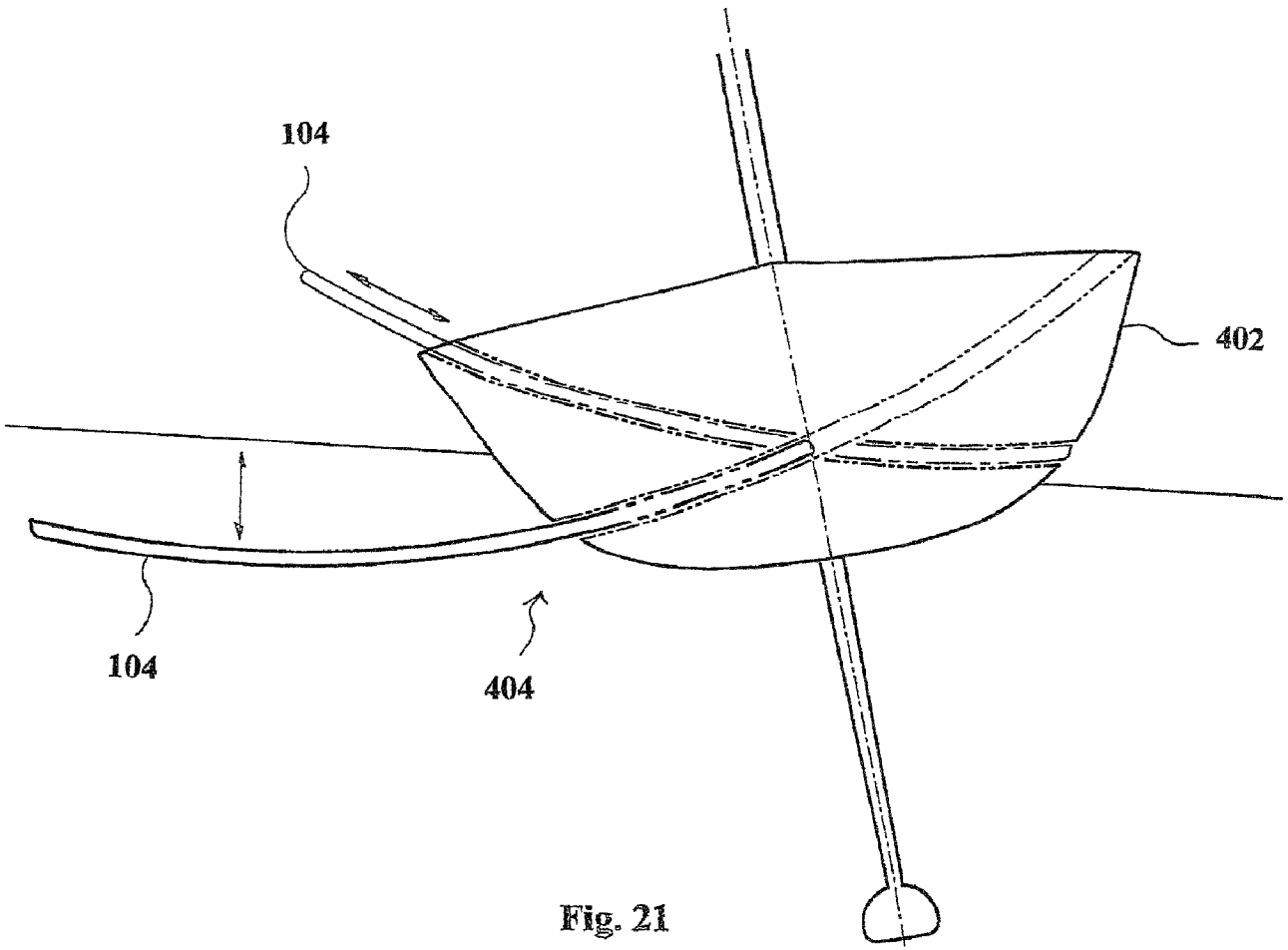
FIG. 21 is a front view looking at the bow of the monohull sailing vessel of FIG. 19 wherein the starboard lifting hydrofoil is shown in the extended position and the port lifting hydrofoil is shown in the stowed position.
Figure 22:
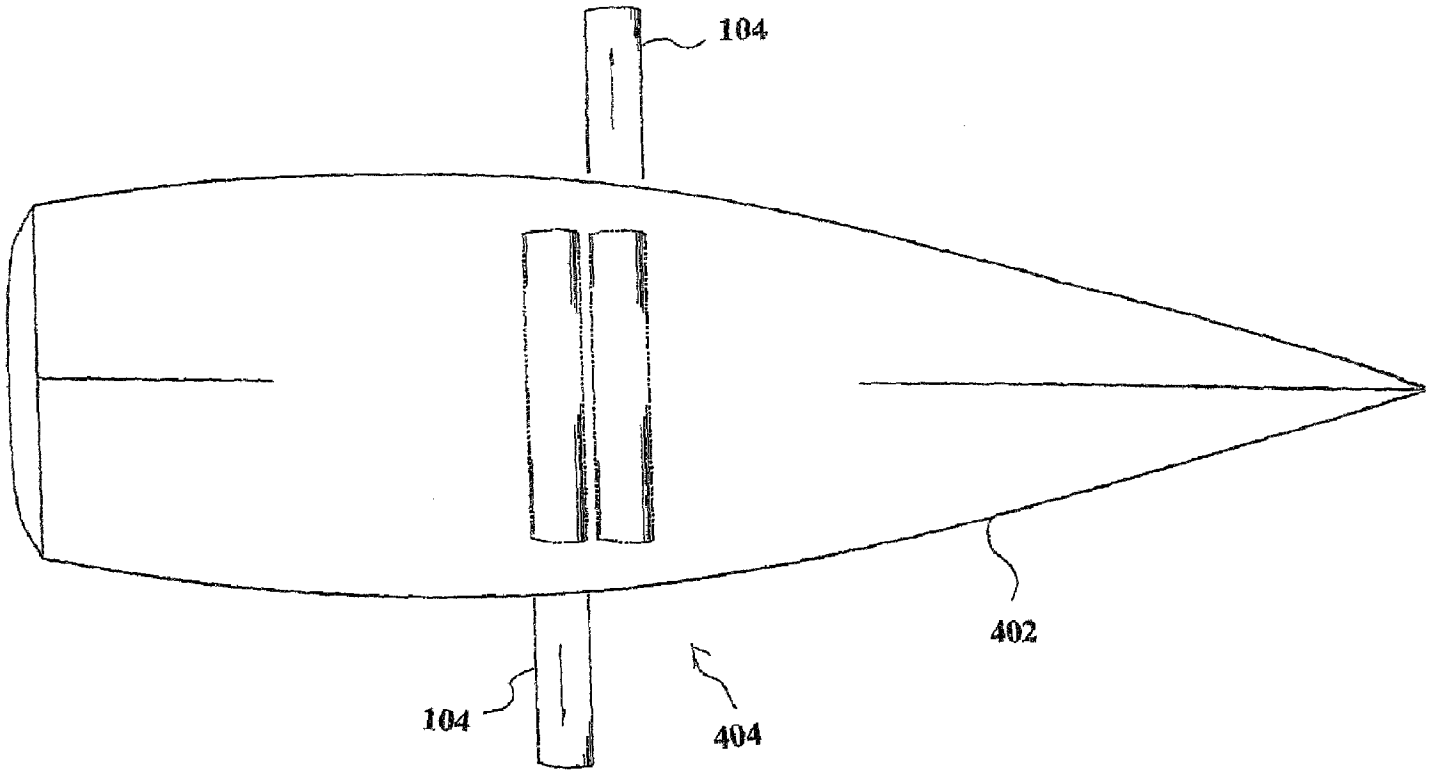
FIG. 22 is a top planar view of a monohull sailing vessel having an alternate embodiment of a hydrofoil system formed in accordance with the present invention wherein a pair of lifting hydrofoils are positioned into an extended position by linearly actuating one of the lifting hydrofoils to the port side when needed and linearly actuating the other lifting hydrofoil to the starboard side of the vessel when needed, and wherein the lifting hydrofoils are oriented so as to extend substantially perpendicular to the centreline of the vessel but offset from one another in the longitudinal direction.

Referring to FIGS. 21 and 22, a monohull sailing vessel 402 having an alternate embodiment of a hydrofoil system formed in accordance with the present invention is shown. In this embodiment, each of a pair of lifting hydrofoils 104 are positioned into an extended position by linearly actuating one of the lifting hydrofoils to the port side when needed and linearly actuating the other lifting hydrofoil to the starboard side of the vessel when needed. The lifting hydrofoils are oriented substantially perpendicular to the centreline of the vessel and are offset from one another in a longitudinal direction such that one of the lifting hydrofoils is disposed forward of the other lifting hydrofoil. Accordingly, the lifting hydrofoils are not disposed symmetrically about the vessel. Moreover, the lifting hydrofoils are asymmetrically disposed about the vessel such that the longitudinal position of the lifting hydrofoil on the port side is different than the longitudinal position of the lifting hydrofoil on the starboard side.

Figure 23:
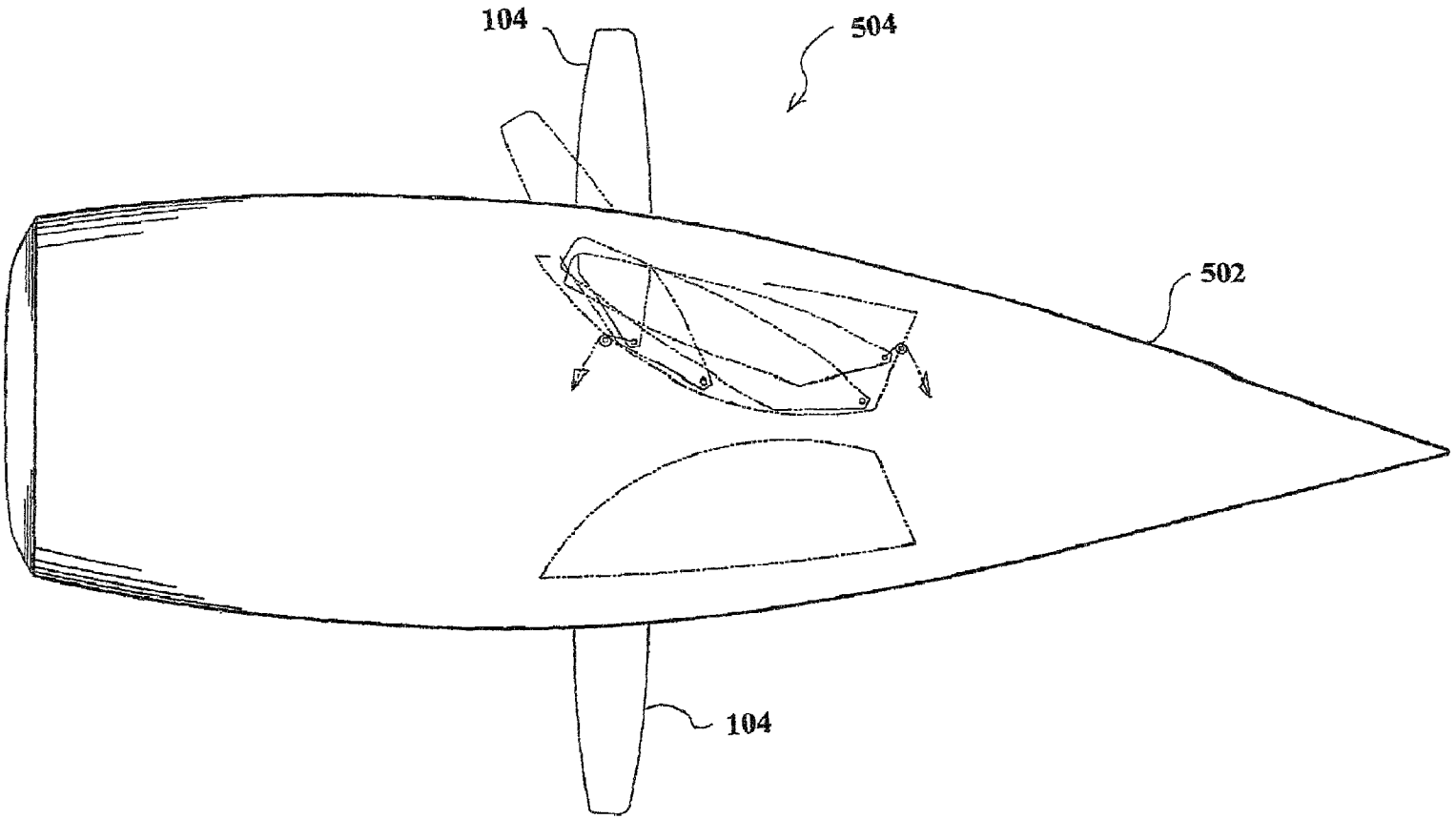
FIG. 23 is a top planar view of a monohull sailing vessel having an alternate embodiment of a hydrofoil system formed in accordance with the present invention wherein each of a pair of lifting hydrofoils are positioned into an extended position by both linear and rotational actuation.

FIG. 23 is a top planar view of a monohull sailing vessel 502 having an alternate embodiment of a hydrofoil system 504 formed in accordance with the present invention. In this embodiment, each of a pair of lifting hydrofoils 104 are positioned into an extended position by both linearly and rotatingly actuating one of the lifting hydrofoils to the port side when needed and linearly and rotatingly actuating the other lifting hydrofoil to the starboard side of the vessel when needed.

Statement of Technical Advantages

A sailing vessel formed in accordance with the present invention may one or more of the following advantages relative to previously developed sailing vessels:

a) less complicated;
b) more reliable;
c) requires less or no adjustment during use;
d) may be operated with little or no training and/or instruction;
e) less costly;
f) light weight;
g) inherently fail-safe,
h) increased performance and stability;
i) decreased angle of heel;
j) decreased water borne surface area;
k) decreased drag;
l) does not affect the ultimate seaworthiness of the yacht;
m) the hydrofoil is sized, configured, and positioned to be self correcting and therefore does not require constant adjustment;
n) the lifting force generated by the hydrofoil may be corrected without the need to adjust the angle of attack, exposed surface area, and/or position of the hydrofoil; and
o) the hydrofoil can survive impacts without significant damage to the hydrofoil and/or without compromising the water integrity of the hull.

Variations

Throughout the description of this specification, the word "comprise," "include," and "have" and variations of those word such as "comprising," "comprises", "including," "includes," "having," and "has" are not intended to exclude other additives, components, integers or steps.

The overall longitudinal trim control may be augmented by the movement of crew weight, water ballast, trim tabs at the stern of the vessel, interceptor devices at the stern of the vessel, adjustable foils mounted on the rudder(s) or other means. However, preferably the normal sailing modes do not require intervention or continual control of any hydrodynamic trim assistance devices. The combined trim effects are also designed to naturally limit the maximum lift coefficients seen by the foil system in order to avoid overstressing of foil, rigging and sail plan. Thus the requirement for continuously variable angle of attack control of the foil itself to control the lift coefficient, or foil projection to control the projected area and span and thus the derived forces and moments is obviated, but may be included if desired.

The above described lifting hydrofoil derived dynamic effects may be employed in sailing vessels with fixed keels with no other form of stability modification, or in sailing vessels employing moveable or variable ballast systems of either canting keel, water ballast or combinations of any or all of these features. The foil or foils may be fixed, fully or partially retractable by any of, or a combination of, the following means:

1. Swinging retraction into case or cases within the hull equipped with suitable sealing devices to minimize drag when either extended or retracted;

2. Sliding retraction into or through case or cases within the hull where the foil itself acts as the closure;
3. Combined sliding and swinging retraction into case or cases within the hull; and
4. Folding retraction into recesses within the hull.

The foil or foils may be of straight, cranked, or curved configuration in any plane. The foil or foils may be suitably angled in any plane to match the designed sailing heel angles of the vessel in question.

The lift coefficient of the foil or foils may be adjusted by means of variable camber devices. Thus leading edge flap, trailing edge flap or other multiple camber inducing configurations are within the spirit and scope of the present invention. This camber adjustment is not essential to the normal operational conditions but is envisaged more as an aid to fine tuning of the lift/drag ratios for best performance of the vessel in question.

Although the illustrated embodiments depict a single lifting hydrofoil extending outward from each side of the vessel, it is pointed out to those skilled in the art that in other embodiments of the invention, two or more lifting foils may be used on each side of the vessel. Preferably, when multiple foils are used on a side, the foils are spaced at about the same vertical height but spaced longitudinally from one another, and preferably positioned in such a manner to have a resultant lifting force from all foils on one side acting near a desired location to automatically control the fore and aft trim as previously described.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

The invention claimed is:

1. A monohull sailing vessel comprising:

(a) a hull with a longitudinal dimension, a bow, a stern, a port side, and a starboard side;

(b) at least one mast for supporting at least one sail, the mast coupled to the hull;

(c) a lifting hydrofoil having a stowed position in which the lifting hydrofoil is disposed inward of the hull and a deployed position in which the lifting hydrofoil is adapted to extend outward of a leeward side of the hull and in the water supporting the vessel;

(d) wherein the lifting hydrofoil has an aspect ratio that is greater than about 2:1;

(e) wherein the lifting hydrofoil when in the deployed position is oriented at a predetermined angle of attack to a fore and aft plane of the vessel, the predetermined angle of attack being between about 2 and 6 degrees;

(f) wherein the lifting hydrofoil when in the deployed position is oriented at a mean angle of between about 5 and 20 degrees to a horizontal plane when the vessel is in a non-heeled state so that the lifting hydrofoil is substantially parallel with a water plane when the vessel is heeled to a normal optimum sailing heel angle;

(g) wherein the lifting hydrofoil when in the deployed position has a projected area adapted provide a righting moment tending to counteract a heeling moment applied by the sail of the vessel and a lifting force for partially but not fully lifting the vessel out of the water;

(h) wherein the lifting hydrofoil has an exposed span that is greater than about 7% of a height of the tallest mast of the vessel, the height measured from the water plane; and (i) an actuation assembly for moving the lifting hydrofoil between the stowed position and the deployed position.

2. The monohull sailing vessel of claim 1, wherein the lifting hydrofoil is coupled to the vessel such that the predetermined angle of attack of the lifting hydrofoil when in the deployed position and while the vessel is underway is static and not adapted for continuous adjustment to selectively control the lifting force produced by the lifting hydrofoil.

3. The monohull sailing vessel of claim 1, wherein the lifting hydrofoil is coupled to the vessel such that the mean angle of the lifting hydrofoil relative to the horizontal plane when in the deployed position and while the vessel is underway is static and not adapted for continuous adjustment to selectively control the lifting force produced by the lifting hydrofoil.

4. The monohull sailing vessel of claim 1, wherein the lifting hydrofoil is coupled to the vessel such that the projected area of the lifting hydrofoil when in the deployed position and while the vessel is underway is static and not adapted for continuous adjustment to selectively control the lifting force produced by the lifting hydrofoil.

5. The monohull sailing vessel of claim 1, wherein the lifting hydrofoil is coupled to the vessel such that the angle of attack, the designed mean angle, and the projected area of the lifting hydrofoil when in the deployed position are static and not adapted for continuous adjustment to selectively control the lifting force produced by the lifting hydrofoil while the vessel is underway.

6. The monohull sailing vessel of claim 1, wherein the lifting hydrofoil is positioned along the longitudinal dimension to be within a predetermined distance of a centre of gravity of the vessel when in sailing trim, the predetermined distance being less than or equal to 15% of a length over all (LOA) of the vessel.

7. The monohull sailing vessel of claim 6, wherein the lifting hydrofoil is positioned aft of the center of gravity of the vessel.

8. The monohull sailing vessel of claim 1, wherein the exposed span of the lifting hydrofoil is greater than about 7% and less than about 20% of the height of the tallest mast of the vessel, the height measured from the water plane.

9. The monohull sailing vessel of claim 1, wherein the hull includes a channel disposed on the starboard side of the hull extending from a point below the waterline to a point above the waterline, the channel adapted to receive the lifting hydrofoil when the lifting hydrofoil is in the stowed position such that the bottom surface of the lifting hydrofoil is substantially flush with the hull.

10. The monohull sailing vessel of claim 1, wherein the aspect ratio of the lifting hydrofoil is greater than about 4:1.

11. The monohull sailing vessel of claim 1, wherein the exposed span of the lifting hydrofoil is between about 30% and 150% of a beam of the vessel measured at a waterline.

12. The monohull sailing vessel of claim 1, wherein the aspect ratio of the lifting hydrofoil is between about 3:1 and 8:1.

13. The monohull sailing vessel of claim 1, wherein the static angle of attack of the lifting hydrofoil is between about 3 and 5 degrees when in the deployed position.

14. The monohull sailing vessel of claim 1, wherein the actuation assembly is adapted to rotate the lifting hydrofoil from the stowed position to the deployed position.

15. The monohull sailing vessel of claim 1, wherein the actuation assembly is adapted to move the lifting hydrofoil athwartships from a starboard extended position in which a starboard end of the lifting hydrofoil is positioned outward of the hull and a port end of the lifting hydrofoil is positioned inward of the hull and a port extended position in which the port end of the lifting hydrofoil is positioned outward of the hull and the starboard end of the lifting hydrofoil is positioned inward of the hull.

16. The monohull sailing vessel of claim 1, wherein the lifting hydrofoil is oriented such that when the lifting hydrofoil is in the deployed position with the monohull sailing vessel in an unheeled state, a distal end of the lifting hydrofoil extends above the water plane.

17. The monohull sailing vessel of claim 1, wherein the lifting hydrofoil is held in the deployed position by a load release mechanism adapted to release the lifting hydrofoil from the deployed position when a load upon the lifting hydrofoil exceeds a predetermined level.

18. The monohull sailing vessel of claim 1, wherein the lifting hydrofoil is rotated between the deployed and stowed positions about a pivot axis that is oriented substantially parallel to the longitudinal dimension of the vessel.

19. The monohull sailing vessel of claim 1, wherein the lifting hydrofoil is housed in a slot in the hull that extends from the starboard side to the port side of the hull, and wherein the lifting hydrofoil is double ended such that the lifting hydrofoil is adapted to be deployed on either the starboard side or the port side of the hull by moving the lifting hydrofoil athwartship in the slot.

20. The monohull sailing vessel of claim 1, wherein the lifting hydrofoil is bowed in the athwartship direction such that when the lifting hydrofoil is in the deployed position and the vessel in a non-heeled state, a distal end of the lifting hydrofoil is at a greater elevation than a proximal end of the lifting hydrofoil.

21. The monohull sailing vessel of claim 1, wherein the vessel includes at least one lifting hydrofoil adapted to extend from the port side when in the deployed position and at least one lifting hydrofoil adapted to extend from the starboard side of the hull in a different longitudinal position from the lifting hydrofoil on the starboard side such that the port and starboard lifting hydrofoils are offset from one another and the lifting hydrofoils are asymmetrically disposed about the vessel.

22. The monohull sailing vessel of claim 1, wherein the lifting hydrofoil, when in the deployed position, is in a swept back orientation such that the lifting hydrofoil is inclined relative to a line oriented perpendicular to a centerline of the boat by a predetermined angle, the predetermined angle being greater than about 5 degrees.

23. The monohull sailing vessel of claim 1, wherein the actuation assembly is adapted to move the lifting hydrofoil between the stowed position and the deployed position by simultaneous linear and rotary actuation.

24. The monohull sailing vessel of claim 1, wherein an intended operation immersion depth of the lifting hydrofoil during operation is between about 50% and 150% of the chord length of the lifting hydrofoil.

* * * * *